US007086192B2

(12) United States Patent
Deros

(10) Patent No.: US 7,086,192 B2
(45) Date of Patent: Aug. 8, 2006

(54) ADJUSTABLE GUN REST APPARATUS

(76) Inventor: Mark A. Deros, 1143 VZ County Rd. 3702, Wills Point, TX (US) 75169

( * ) Notice: Subject to any disclaimer, the term of this patent is extended or adjusted under 35 U.S.C. 154(b) by 35 days.

(21) Appl. No.: 10/630,323

(22) Filed: Jul. 30, 2003

(65) Prior Publication Data

US 2004/0020097 A1 Feb. 5, 2004

Related U.S. Application Data

(60) Provisional application No. 60/400,666, filed on Aug. 2, 2002.

(51) Int. Cl.
*F41A 23/02* (2006.01)
*F41A 23/14* (2006.01)
*F41A 23/16* (2006.01)

(52) U.S. Cl. ..... 42/94; 89/37.04; 248/278.1

(58) Field of Classification Search ..... 42/94; 89/37.04, 37.09, 37.13, 40.06; 248/278.1, 248/122.1, 125.3, 163.1, 431, 165, 166, 434, 248/435, 440.1, 188.7
See application file for complete search history.

(56) References Cited

U.S. PATENT DOCUMENTS 3,358,504 A * 12/1967 Freebairn ..... 73/167
3,762,269 A * 10/1973 Rusbach ..... 89/40.06
3,827,172 A * 8/1974 Howe ..... 42/94
4,007,554 A 2/1977 Helmstadter
4,854,066 A 8/1989 Canterbury, Sr.
4,967,497 A * 11/1990 Yakscoe ..... 42/94
4,972,619 A * 11/1990 Eckert ..... 42/94
5,067,268 A * 11/1991 Ransom ..... 42/94
5,081,783 A * 1/1992 Jarvis ..... 42/94
5,347,740 A 9/1994 Rather et al.
5,628,135 A 5/1997 Cady
5,697,181 A 12/1997 Savant
5,913,668 A 6/1999 Messer
5,974,719 A 11/1999 Simonek
6,237,462 B1 * 5/2001 Hawkes et al. ..... 89/41.05
6,283,428 B1 * 9/2001 Maples et al. ..... 248/282.1
6,305,117 B1 10/2001 Hales, Sr.
6,338,218 B1 1/2002 Hegler
6,390,426 B1 5/2002 Berry
6,526,687 B1 3/2003 Looney
6,554,238 B1 * 4/2003 Hibberd ..... 248/278.1
6,931,777 B1 * 8/2005 Krien ..... 42/94
D515,168 S * 2/2006 Ruhland et al. ..... D22/108
2005/0183320 A1 * 8/2005 Krien et al. ..... 42/94

* cited by examiner

*Primary Examiner*—Michael J. Carone
*Assistant Examiner*—James S. Bergin
(74) *Attorney, Agent, or Firm*—Slater & Matsil, L.L.P.

(57) ABSTRACT

A gun support apparatus is provided, which includes a base portion, a first arm member, and a second arm member. The first arm member is attached to the base portion. The second arm member is attached to the base portion. Each of the first and second arm members includes an upright member, a distal support member, a first link, and a second link. The first link is pivotably coupled to the upright member and attached to the distal support member, such that the first link is located between the distal support member and the upright member. The second link is pivotably coupled to the upright member and pivotably coupled to a distal end of the first link, such that the second link is located between the distal support member and the upright member. The second link has a variable length, and may include a dampener, spring, and/or friction element.

27 Claims, 32 Drawing Sheets

ADJUSTABLE GUN REST APPARATUS

This application claims the benefit of U.S. Provisional Application No. 60/400,666, filed on Aug. 2, 2002, entitled Versa Gun Rest, which application is hereby incorporated herein by reference.

TECHNICAL FIELD

The present invention relates to gun rests or gun support systems, and more particularly to adjustable gun rests.

BACKGROUND

Many existing gun rests have very limited adjustment capability. Also, many existing gun rests cannot be used with a wide variety of firearms (e.g., pistols, rifles, long-clip magazines, machine guns). For example, many existing gun rests may only be used for rifles that do not have long clips or magazines. It may be desirable to have a single gun rest capable of being used for many different sizes and shapes of firearms. It may also be desirable to have a gun rest that may also be used for other household or workshop functions, as a tool, rather than just being useful to holding certain guns. Hence, a need exists in some applications for a gun rest having high adjustability and versatility, and/or adaptability to other non-shooting uses.

Many existing gun rests do not allow for pivotal movement of the support arm(s) to allow for changing targets without moving the entire gun rest. In hunting applications, the target may be moving continuously or intermittently, and it is unlikely that the target will walk or fly to a position aligned with the existing position of the gun barrel supported by a gun rest. In most hunting situations, it is critical to remain silent-and to avoid sudden or rapid movements. Having to move an entire gun rest while it is supporting a gun may be noisy, cumbersome, and/or disruptive to the hunt. Thus, it would be desirable in some applications to have a gun rest that allows the gun support arms to be pivoted easily, controllably, and/or quietly.

When shooting at a target at a long range, slight movements of the gun barrel translate into large deviations from the target. Hence, accuracy and precision of gun barrel movement becomes critical to providing skillful long range shooting. Although most existing gun rests provide for barrel tilt adjustments via one or more adjustable arms and/or adjustable feet, many do not provide precise or minute adjustments for fine tuning an aim on a long range target. Also, many existing gun rests are unstable and cumbersome to adjust. In a hunting situation, adjustments often need to be made quickly, controllably, and precisely, especially for a long range target. Hence, a need exists in some applications for a gun rest that provides precise and minute adjustment that may be made quickly, easily, and controllably.

Also, existing gun rests do not provide precise or fine-tuned windage adjustments. When shooting at a long-range target while seeking high accuracy, the wind direction must be taken into account. For example, if the wind is blowing from left to right relative to the shooter, the shooter will need to compensate for the wind (direction and velocity) by aiming slightly to the left of the target. For a long-range target, minute movements of the gun barrel to the left or right will translate into much larger movements at the target. Thus, a need exists for a gun rest that provides the ability to make precise and minute windage adjustments.

Furthermore, many existing gun rest are affected by vibrations. Some gun rests even amplify vibrations. When shooting at a very long range target, even the vibrations or movement caused by the shooter's heart beat or pulse may cause enough movement on an unstable gun rest to cause significant aiming errors. Also, often a shooter will want or need to make several successive shots. In such situations, the vibrations from a prior shot need to be quickly dissipated and/or at least partially absorbed by the gun rest to enable a rapid subsequent aim and shot. Thus, a more structurally sound gun rest that is less affected by vibrations or that even absorbs vibrations would be highly desirable for some applications.

Weaker, injured, disabled, and/or handicapped persons who desire to hunt or target shoot are sometimes unable or limited in their ability to do so. For example, a person that has an injured or disabled arm or hand may need the assistance of a gun rest to provide support for the gun. In such case, the shooter may be limited to one hand operations. Hence, it would be desirable to have a gun rest that is easily adjusted with one hand, for example. Also, many existing gun rests are not adaptable for use with a wheel chair. Thus, it may be desirable to have a gun rest capable of being used from a wheel chair for some applications.

BRIEF SUMMARY OF THE INVENTION

The problems and needs outlined above are addressed by various aspects of the present invention. In accordance with one aspect of the present invention, a gun support apparatus is provided, which includes a base portion, a first arm member, and a second arm member. The first arm member is attached to the base portion. The second arm member is attached to the base portion. Each of the first and second arm members includes an upright member, a distal support member, a first link, and a second link. The first link is pivotably coupled to the upright member and attached to the distal support member, such that the first link is located between the distal support member and the upright member. The second link is pivotably coupled to the upright member and pivotably coupled to a distal end of the first link and/or to the distal support member, such that the second link is located between the distal support member and the upright member. The second link has an variable length. The first link may have a variable or adjustable length. However, the first link for at least one of the arm members may have a fixed length.

Preferably, the first and/or second arm members are pivotably coupled to the base portion. Also, the first and second arm members are preferably both configured to pivot about a same axis. The base portion may include an upright shaft extending along the pivotal axis for the first and second arm members, such that the first arm member is pivotably coupled to the upright shaft, and the second arm member is pivotably coupled to the upright shaft adjacent to the first arm member. The upright shaft may extend through the upright members of the first and second arm members. A washer may be located about the upright shaft and located between the first and second arm members. The washer may be made from a non-metal material.

In another embodiment, the first arm member may be configured to pivot about a first axis and the second arm member may be configured to pivot about a second axis, wherein the first axis is not aligned with the second axis. Hence, the base portion may include a first upright shaft and a second upright shaft, such that the first upright shaft extends along the first axis, the first upright shaft extends through the upright member of the first arm member, the second upright shaft extends along the second axis, the second upright shaft extends through the upright member of the second arm member, and the second upright shaft is adjacent to the first upright shaft.

In yet another embodiment, the second link for at least one of the arm members may include a shaft portion and a knob portion. The shaft portion may have a threaded end. The knob portion may have a threaded hole formed therein, wherein the threaded end of the shaft portion is adapted to mate with the threaded hole. In still another embodiment, the second link for at least one of the arm members may be a slider link including a piston portion and a cylinder portion, wherein the piston portion is adapted to slidably fit within the cylinder portion. The piston portion may include a friction element adapted to provide a predetermined coefficient of friction between the piston portion and the cylinder portion, for example. In another embodiment, the second link for at least one of the arm members may include a dampener portion and/or a spring member.

The first link for at least one of the arm members may be pivotably coupled to the distal support member. The distal support member for at least one of the arm members may have a generally U-shaped cradle portion. The base portion may include three legs extending therefrom, and the legs may be pivotably coupled to the base portion to provide an adjustable height for the base portion. The legs may have adjustable lengths. The first arm member may be fixedly attached to the base portion and the second arm member may be pivotably coupled to the base portion. The distal support member for at least one of the arm members may include a clamp portion. The base portion may include a plate-shaped platform portion. The distal support member for at least one of the arm members may include a plate-shaped platform portion. The distal support member for at least one of the arm members may include a generally J-shaped cradle portion. The base portion may include a tripod structure. The base portion may include a mounting bracket adapted to clamp onto another object. The base portion may include a storage tray extending therefrom. The distal support member for at least one of the arm members may include a bracket adapted to retain a camera and/or a light. A third arm member may be attached to and extend from the base portion. The gun support apparatus may include a dampener member attached to and extending between the first and second arm members. The base portion may include a bracket adapted for attachment to a wheelchair. The distal support member for at least one of the arm members may include a bracket adapted to retain a fishing pole.

In accordance with another aspect of the present invention, a gun support apparatus is provided, which includes a shaft, a first arm member, and a second arm member. The shaft extends along a longitudinal axis. The first arm member is pivotably coupled to the shaft such that the first arm member may pivot about the longitudinal axis. The second arm member is pivotably coupled to the shaft such that the second arm member may pivot about the longitudinal axis. The second arm member is adjacent the first arm member along the longitudinal axis of the shaft.

In accordance with still another aspect of the present invention, a gun support apparatus is provided, which includes a base portion, a first link, and a second link. The first link extends along a first link axis and attached to the base portion at a proximate end of the first link. The second link extends along a second link axis and attached to the base portion at a proximate end of the second link. A distal end of the second link is attached to a distal end of the first link. An angle formed between the first link axis and the second link axis is less than 90 degrees. The second link includes a shaft portion and a knob portion. The shaft portion has a threaded end. The knob portion has a threaded hole formed therein. The threaded end of the shaft portion is adapted to mate with the threaded hole to provide a variable length for the second link. The angle formed between the first link axis and the second link axis is preferably less than about 45 degrees. In a preferred embodiment, the angle formed between the first link axis and the second link axis is about 30 degrees, for example.

In accordance with yet another aspect of the present invention, a gun support apparatus is provided, which includes a base portion, a first link, and a second link. The first link extends along a first link axis and is attached to the base portion at a proximate end of the first link. The second link extends along a second link axis and attached to the base portion at a proximate end of the second link. A distal end of the second link is attached to a distal end of the first link. An angle formed between the first link axis and the second link axis is less than 90 degrees. The second link includes a slider mechanism adapted to provide a variable length for the second link. The angle formed between the first link axis and the second link axis is preferably less than about 45 degrees. In a preferred embodiment, the angle formed between the first link axis and the second link axis is about 30 degrees, for example. The slider mechanism may include a piston portion and a cylinder portion, wherein the piston portion is adapted to slidably fit within the cylinder portion. The piston portion may include a friction element adapted to provide a predetermined coefficient of friction between the piston portion and the cylinder portion. The slider mechanism may include a dampener and/or a spring.

In accordance with a further aspect of the present invention, a gun support apparatus is provided, which includes a base portion, a first arm member, and a second arm member. The first arm member is attached to the base portion. The second arm member is attached to the base portion. The first arm member includes a first upright member, a first distal support member, and a first slider mechanism. The first slider mechanism is pivotably coupled to the first upright member and pivotably coupled to the first distal support member, such that the first slider mechanism is located between the first distal support member and the first upright member. The first distal support member may be adapted to be removably attached to a gun. The first slider mechanism may include a piston portion and a cylinder portion, wherein the piston portion is adapted to slidably fit within the cylinder portion. The piston portion may include a friction element adapted to provide a predetermined coefficient of friction between the piston portion and the cylinder portion. The first slider mechanism may include a dampener and/or a spring. The second arm member may include a second upright member, a second distal support member, and a second slider mechanism. In such case, the second slider mechanism is pivotably coupled to the second upright member and pivotably coupled to the second distal support member, such that the second slider mechanism is located between the second distal support member and the second upright member. The base portion may include an upright shaft, wherein the upright shaft extends through the first and second upright members such that the first and second arm members are pivotably coupled to the base portion via the upright shaft.

In accordance with still another aspect of the present invention, gun support system is provided, which includes a base portion, gun support arms, and a storage tray. The gun support arms are attached to and extend from the base portion. The storage tray is attached to and extends from the base portion. The gun support system may include at least three legs attached to and extending from the base portion. For example, the base portion may include a tripod stand, where the three legs are part of the tripod stand. In such case, the tray may be located between the gun support arms and the tripod stand, for example. Preferably, the legs have adjustable lengths (e.g., for standing or sitting uses). The base portion may include a mounting bracket adapted to clamp onto another object. As another alternative, the base portion may include a bracket adapted for attachment to a wheelchair.

In accordance with yet another aspect of the present invention, a gun support kit for use with a wheelchair is provided, which includes in the kit: a base portion and gun support arms. The base portion is adapted for being attached to a wheelchair. The gun support arms are attached to and extend from the base portion. Preferably, at least one of the gun support arms is pivotably coupled to the base portion to allow for pivotal movement relative to the base portion. The base portion may be adapted to be permanently or removably attached to a wheelchair.

In accordance with another aspect of the present invention, a method of assembling a gun support apparatus is provided. This method includes the following steps, the order of which may vary. First and second arm members are assembled. The assembling of each of the arm members includes: attaching a first link to an upright member; attaching the first link to a distal support member, such that the first link is located between the distal support member and the upright member; attaching a second link to the upright member; and attaching the second link to the first link, wherein the second link has an variable length. The first arm member is attached to a base portion. The second arm member is attached to the base portion.

In accordance with still another aspect of the present invention, a method of assembling a gun support apparatus is provided. This method includes the following steps, the order of which may vary. A first arm member is attached to a shaft. The shaft extends along a longitudinal axis. The first arm member is pivotable about the longitudinal axis relative to the shaft. A second arm member is also attached to the shaft such that the second arm member may pivot about the longitudinal axis. The second arm member is adjacent the first arm member along the longitudinal axis of the shaft when the gun support apparatus is operably assembled.

In accordance with yet another aspect of the present invention, a method of assembling a gun support apparatus is provided. This method includes the following steps, the order of which may vary. First and second arm members are assembled. The assembling of each of the arm members includes: attaching a slider mechanism to an upright member, and attaching the slider mechanism to a distal support member. The slider mechanism is located between the distal support member and the upright member. The first arm member is attached to a base portion. The second arm member is also attached to the base portion.

BRIEF DESCRIPTION OF THE DRAWINGS

The following is a brief description of the drawings, which show illustrative embodiments of the present invention and in which.

DETAILED DESCRIPTION OF ILLUSTRATIVE EMBODIMENTS

Figure 1:
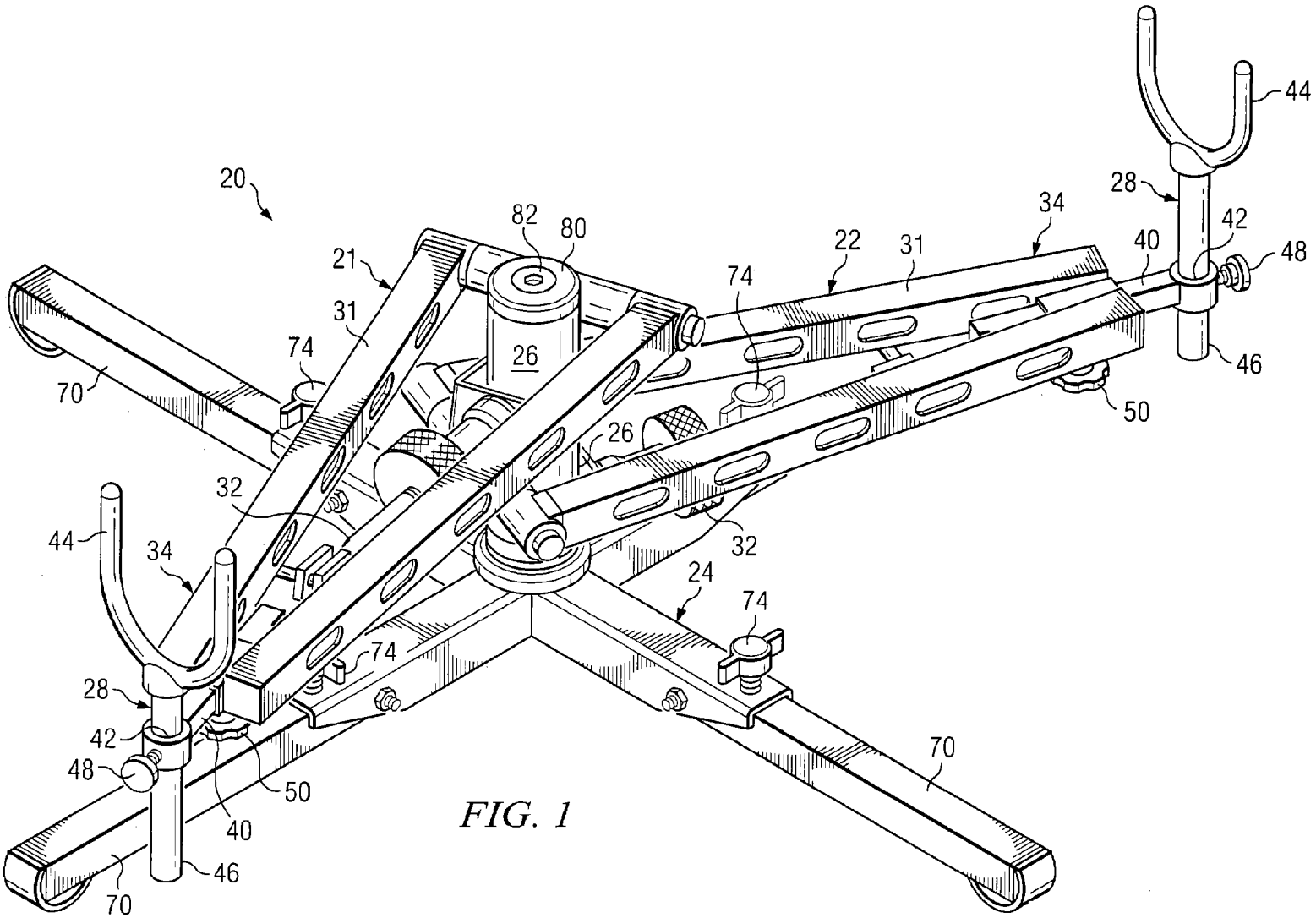
FIG. 1 is a perspective view of a first embodiment of the present invention.

Referring now to the drawings, wherein like reference numbers are used herein to designate like elements throughout the various views, illustrative embodiments of the present invention are shown and described. The figures are not necessarily drawn to scale, and in some instances the drawings have been exaggerated and/or simplified in places for illustrative purposes only. One of ordinary skill in the art will appreciate the many possible applications and variations of the present invention based on the following illustrative embodiments of the present invention.

Figure 2:
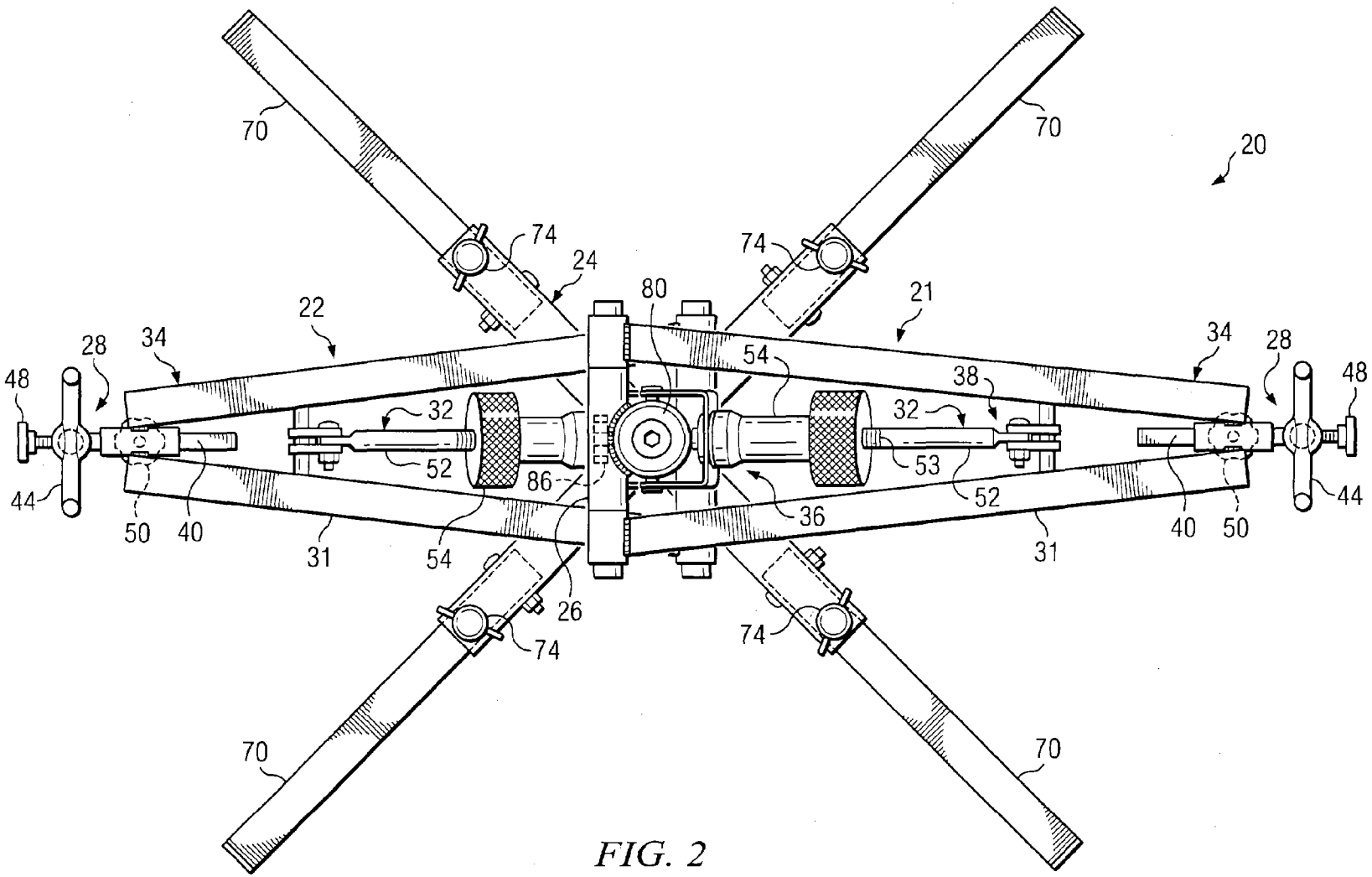
FIG. 2 is a top view of the first embodiment of FIG. 1.

FIGS. 1–6 illustrate a first embodiment of the present invention. FIG. 1 is a perspective view of an adjustable gun rest 20 of the first embodiment. FIG. 2 is a top view of the gun rest 20 of FIG. 1. FIGS. 1–6 will be described next in detail, however, various aspects and features of the first embodiment (shown in FIGS. 1–6) may be varied, changed, deleted, altered, and/or substituted to form other embodiments in accordance with the present invention.

Figure 3:
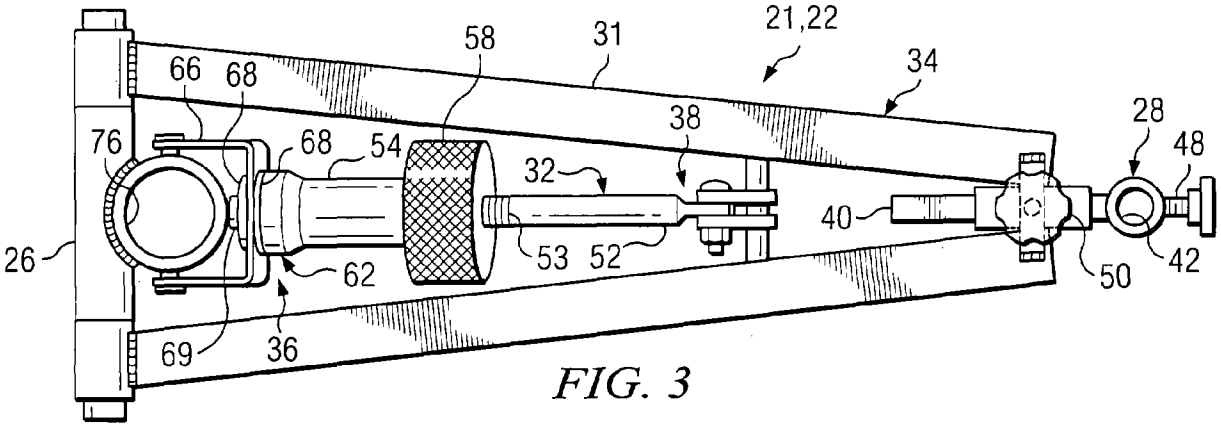
FIG. 3 is a bottom view of an arm member of the first embodiment.

Referring to FIGS. 1 and 2, the gun rest 20 of the first embodiment has two arm members 21, 22 attached to a base portion 24. In this case, the two arm members 21, 22 are pivotably coupled to the base portion 24, as will be described in detail below. FIG. 3 is a bottom view for one of the arm members 21 from the gun rest 20 of FIGS. 1 and 2. Each arm member 21, 22 may have an upright member 26, a distal support member 28, a first link 31, and a second link 32. The first link 31 may be pivotably coupled to the upright member 26 and attached to the distal support member 28. The first link 31 may have a fixed length and may be pivotably coupled to the upright member 26 with a hinge coupling, for example. The distal support member 28 is attached to a distal end 34 of the first link 31. Hence, the first link 31 is located between the distal support member 28 and the upright member 26.

The second link 32 may be attached to the upright member 26 at a proximate end 36 of the second link 32 and may be attached to the first link 31 and/or the distal support member 28 at a distal end 38 of the second link 32. In the first embodiment shown in FIGS. 1–3, the second link 32 is pivotably attached to the upright member 26 and pivotably attached to the distal end 34 of the first link 31. The second link 32 preferably has a variable or adjustable length. Varying the length of the second link 32 causes the angle of the first link 31 relative to the upright member 26 (and relative to the base portion 24) to vary, which has the effect of raising/lowering the distal end 34 of the first link 31. One of the advantages of the first embodiment is that length changes in the second link 32 translate into much smaller height adjustments for the distal end 34 of the first link 31. Hence, the height for the distal end 34 of the first link 31 may be varied by very small and precise amounts. This is useful for long range aiming with a gun, as slight elevation/tilt changes in a gun barrel translate to large elevation changes in aim for a long distance target. This advantage and others will be discussed further below in conjunction with the illustrative figures.

As shown in FIGS. 1 and 2, the distal support member 28 may include a slider shaft 40 with an attachment hole 42, and a generally U-shaped cradle portion 44. The U-shaped cradle portion 44 may have a cradle shaft 46 extending therefrom for use in attaching the cradle portion 44 to the slider shaft 40. As shown in FIG. 1, the cradle shaft 46 may extend through the attachment hole 42 of slider shaft 40 to couple the cradle portion 44 to the slider shaft 40. A cradle set screw 48 with a knob may be used to retain the position of the cradle portion 44 relative to the slider shaft 40. Because the cradle shaft 46 has a round cross-section in this embodiment, the cradle portion 44 may be pivoted within the attachment hole 42 to provide numerous positions for the cradle portion 44. When the cradle portion 44 is set to a desired height and rotational position relative to the slider shaft 40, the cradle set screw 48 may be used to maintain the desired position of the cradle portion 44. A user may easily and quickly change the position of the cradle portion 44 without tools due to the knob provided on the cradle set screw 48 in this example.

In FIG. 3, the slider shaft 40 is shown without the cradle portion 44 attached thereto. As will be apparent from this disclosure, many different or optional support members or cradle members 44 may be attached to the slider shaft 40 to provide more versatility and uses of the gun rest 20. As shown in FIG. 3, the distal support member 28 may be slidably and removably attached to the distal end 34 of the first link 31. A distal support member set screw 50 is provided to allow adjustment of the position of the distal support member 28 relative to the first link 31. Also, other distal support members 28 may be insert and interchanged at the distal end 34 of the first link 31, as desired. Preferably, the distal support member set screw 50 has a knob attached thereto, which allows for tool-free adjustments.

As shown in FIG. 1, the slider shaft 40 of this embodiment has a square cross-section shape, which prevents the slider shaft 40 from pivoting relative to the first link 31 when operably installed. In other embodiments, however, the slider shaft 40 may have other cross-section shapes, including but not limited to: round, oval, rectangular, triangular, and hexagonal, for example. Likewise, the cradle shaft 46 may have other cross-section shapes in other embodiments.

Referring to FIGS. 1 and 2, the cradle portion 44 is preferably made from metal (e.g., steel, aluminum) with a rubber coating at the U-shaped portion. The rubber coating may be applied by dipping the U-shaped portion of the cradle portion 44 into molten rubber. The rubber coating provides several advantages, including: preventing the gun rest from scratching or damaging a gun stock during use, preventing or hindering a gun from sliding along the cradle portion during use, and absorbing vibrations and/or shock to or from the gun during use of the gun rest, for example. In other embodiments, the cradle portion 44 may be uncoated, wrapped with leather or cloth, or coated with another material, for example.

In the first embodiment, the first link 31 is made from steel tubing welded together. But in other embodiments, the first link 31 may be made from other materials, including but not limited to: aluminum, titanium, carbon fiber composite, thermoplastic, nylon composite, or wood, for example. Also, the first link 31 may be formed from a single billet of material, or from multiple pieces of same or different materials joined together (e.g., glue, adhesive, welded, bonded, screwed, bolted, riveted), for example. The first link 31 may be cast, forged, or extruded material, for example. With the benefit of this disclosure, one of ordinary skill in the art will realize many different variations on the form and manufacture of the first link 31.

Figure 5:
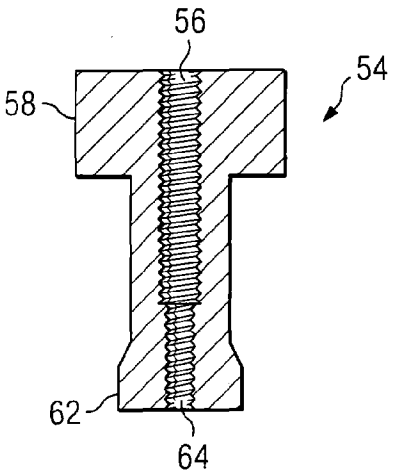
FIG. 5 is a sectional view of the knob portion as taken along line 5—5.
Figure 4:
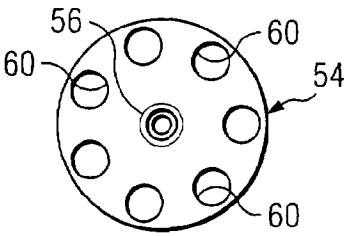
FIG. 4 is an end view of knob portion of the first embodiment.

Still referring to FIGS. 1–3, the second link 32 of the first embodiment may have a shaft portion 52 with a threaded end 53 and a knob portion 54 with a threaded hole 56 formed therein. The threaded end 53 of the shaft portion 52 is adapted to mate with the threaded hole 56 of the knob portion 54. FIGS. 4 and 5 show enlarged views of the knob portion 54. FIG. 4 is an end view of the knob portion 54. FIG. 5 is a sectional view of FIG. 4 as taken along line 5—5. The threaded hole 56 is shown in FIGS. 4 and 5. As the threaded end 53 of the shaft portion 52 is threaded into the threaded hole 56 of the knob portion 54, the length of the second link 32 is varied. The knob portion 54 may have a knurled outer ring 58 to provide enhanced grip of the knob portion 54. This knurled outer ring 58 is preferably made with a larger diameter than the remainder of the knob portion 54 to provide more precise movement and control of the knob portion's rotation during adjustment of the second link's length (i.e., adjusting the height of the distal support member 28 at the distal end 34 of the first link 31). As shown in FIG. 4, the knob portion 54 may have decorative holes 60 formed therein, as an optional feature. These decorative holes 60 may be desired to reduce the weight of the gun rest 20, which may enhance the portability of the gun rest 20. The knob portion 54 may be made from a variety of materials, including but not limited to: aluminum, steel, brass, nickel, iron, wood, plastic, nylon, thermoplastic, phenolic, or any combination thereof, for example. The knob portion 54 is preferably machined from a single piece of cast, forged, and/or billet material block, for example, but may be made in other ways as well.

As shown in FIG. 3, a proximate end 62 of the knob portion 54 has a second threaded hole 64 therein, which may or may not match the thread pattern, diameter, and/or pitch of the threaded hole 56. In the first embodiment, the proximate end 62 of the knob portion 54 is bolted to a U-shaped bracket 66. The U-shaped bracket 66 may be pivotably coupled to the upright member 26. This U-shaped bracket 66 may be part of the second link 32 or part of the upright member 26, for example. The U-shaped bracket 66 is preferably made from steel sheet metal, but it may be made from other materials and processes as well. A non-metal washer 68 and/or a metal washer 68 may be provided between the U-shaped bracket 66 and the knob portion 54 and/or between the U-shaped bracket 66 and the knob retaining screw 69. Such washer(s) 68 allow the knob portion 54 to rotate more smoothly and more easily relative to the U-shaped bracket 66. It is preferred to use a non-metal, low-friction washer 68 between the knob portion 54 and the U-shaped bracket 66. The non-metal washer 68 may be made from a variety of materials, including but not limited to: Teflon material, plastic, nylon, phenolic material, wood, silicon, fiberglass, graphite composite material, or any combination thereof, for example. A metal washer 68 may be made from a variety of metal materials, including but not limited to: steel, brass, nickel, titanium, bronze, pewter, lead, beryllium steel alloy, cobalt steel alloy, or any combination thereof, for example.

Referring again to FIGS. 1 and 2, the base portion 24 of the first embodiment includes adjustable legs 70 and an upright shaft 72 (discussed further below). The base portion 24 of this embodiment has four legs 70, each of which may be independently adjusted in their angle relative to the remainder of the base portion 24. In other embodiments, there may be no legs, or the number of legs may differ (e.g., one stake-shaped leg for driving into the ground, three legs, etc.). A leg 70 of a base portion 24 in other embodiments may not have an adjustable height and/or length. Each leg 70 may have leg height adjustment screws 74, as shown in FIGS. 1 and 2. As a leg height adjustment screw 74 is turned, the angle of the respective leg 70 changes relative to the remainder of the base portion 24, which varies the height of the base portion 24 at that leg 70. Other variations on the base portion 24 will be discussed further below with respect to other embodiments, some of which are illustrated in the figures herein.

Figure 6:
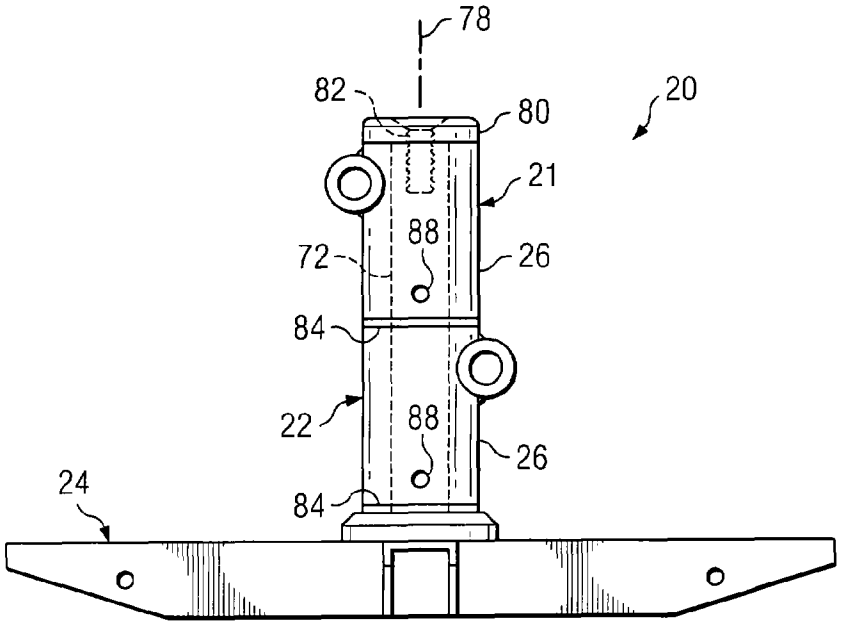
FIG. 6 is a side view for part of the first embodiment.

FIG. 6 is a side view showing part of the first embodiment, with other parts removed for illustration. Specifically, FIG. 6 shows part of the base portion 24 with the upright members 26 of the first and second arm members 21, 22 installed thereon. Referring to FIGS. 3 and 6, the upright members 26 may have a round hole 76 formed there through. The base portion 24 may include an upright shaft 72 extending therefrom. As shown in FIG. 6, the upright shaft 72 may extend through the first and second upright members 26, such that the first and second arm members 21, 22 are adjacent to each other along a rotational axis 78 of the upright shaft 72. Hence, the first and second arm members 21, 22 (via the first and second upright members 26) may pivot or rotate about the same axis 78 of the upright shaft 72.

As shown in FIG. 6, an end cap 80 may retain the first and second arm members 21, 22 on the upright shaft 72 of the base portion 24. In the first embodiment, an end cap screw 82 threads into a threaded hole formed in the end of the upright shaft 72 and extends through a beveled hole in the end cap 80. In other embodiments, however, the end cap 80 may have a threaded shaft portion (not shown) extending therefrom integral to the end cap 80, for example. As shown in FIG. 6, a washer 84 may be provided between the first and second upright members 26. Also, a washer 84 may be provided between the second upright member 26 and the base portion 24. Such washers 84 may be metal or non-metal. Preferably, a non-metal, low-friction washer 84 is used to provide more smooth and controlled pivotal movement of the arm members 21, 22 about the base portion 24. A non-metal washer 84 may be made from a variety of materials, including but not limited to: Teflon material, plastic, nylon, phenolic material, wood, silicon, fiberglass, graphite composite material, or any combination thereof, for example. A metal washer 84 may be made from a variety of metal materials, including but not limited to: steel, brass, nickel, titanium, bronze, pewter, lead, beryllium steel alloy, cobalt steel alloy, or any combination thereof, for example.

Referring to FIGS. 2 and 6, an upright member set screw 86 may be used to retain the rotational position of an upright member 26 relative to the base portion 24. Preferably, the upright member set screw 86 has a knob to allow for tool-free adjustments. FIG. 6 shows threaded holes 88 that may be formed in the upright members 26 for engaging with upright member set screws 86. The gun rest apparatus 20 may be disassembled for storage and/or transporting it by removing the end cap 80 and sliding the arm members 21, 22 off of the upright shaft 72. In a preferred embodiment, a circumferential groove (not shown) may be formed in the upright shaft 72, as an optional feature, at the height on the upright shaft 72 where an upright member set screw 86 engages the shaft 72. When the upright member set screws 86 are tightened many times against the shaft 72 during use of the gun rest, it may cause scratches, gouges, and/or ruts to be formed in shaft 72. Such abrasions to the shaft 72 may hinder the arm members 21, 22 from easily sliding on and off the shaft 72. Adding strategically placed grooves in the shaft 72 can provide a recessed portion where such abrasions on the shaft 72 may not affect the movement of the arm members 21, 22 relative to the shaft 72.

Figure 7:
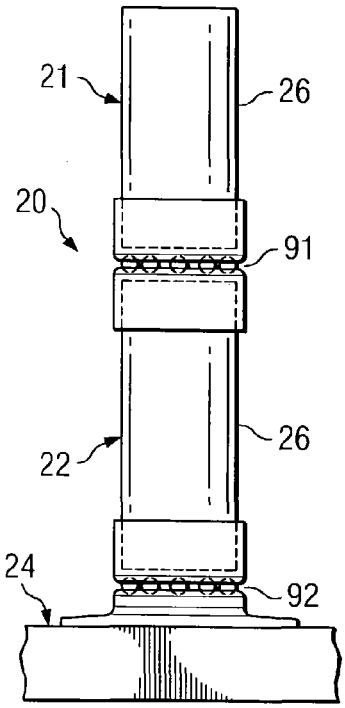
FIG. 7 is a side view for part of a second embodiment of the present invention.
Figure 8:
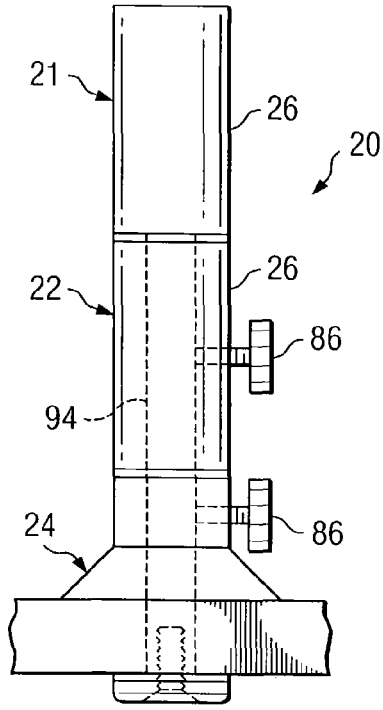
FIG. 8 is a side view for part of a third embodiment of the present invention.
Figure 9:
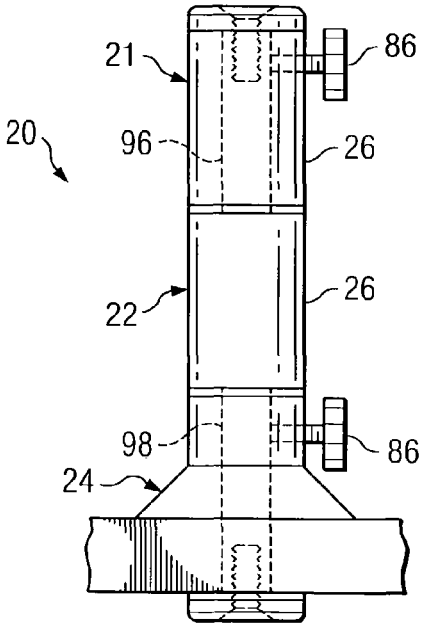
FIG. 9 is a side view for part of a fourth embodiment of the present invention.

The upright shaft 72 and another part of the base portion 24 may be formed for a single piece of material, or the upright shaft 72 may be attached via a weld and/or threads, for example. Although the base portion 24 of the first embodiment includes an upright shaft 72, it may not in other embodiments of the present invention. For example, FIGS. 7–9 show alternative embodiments where the base portion 24 does not include an upright shaft 72 as in the first embodiment. FIGS. 7–9 show only a portion of each embodiment for purposes of comparison to FIG. 6 and for purposes of simplifying the illustration. Part of a second embodiment is shown in FIG. 7, in which a first upright member 26 of a first arm member 21 is pivotably coupled to a second upright member 26 of a second arm member 22 via a first bearing 91. Similarly, in FIG. 7 the second upright member 26 of the second arm member 22 is pivotably coupled to a base portion 24 via a second bearing 92.

Part of a third embodiment is shown in FIG. 8, in which a first upright member 26 of a first arm member 21 has a shaft portion 94 extending therefrom. The shaft portion 94 extends through a second upright member 26 of a second arm member 22 and through a base portion 24. Hence, the shaft portion 94 of the third embodiment is part of the first arm member 21.

Part of a fourth embodiment is shown in FIG. 9, in which a second upright member 26 of a second arm member 22 has two shaft portions 96, 98 extending therefrom. A first shaft portion 96 extends through a first upright member 26 of a first arm member 21. A second shaft portion 98 extends through a base portion 24. Thus, in the fourth embodiment, shaft portions 96, 98 are part of the second arm member 22.

Figure 10:
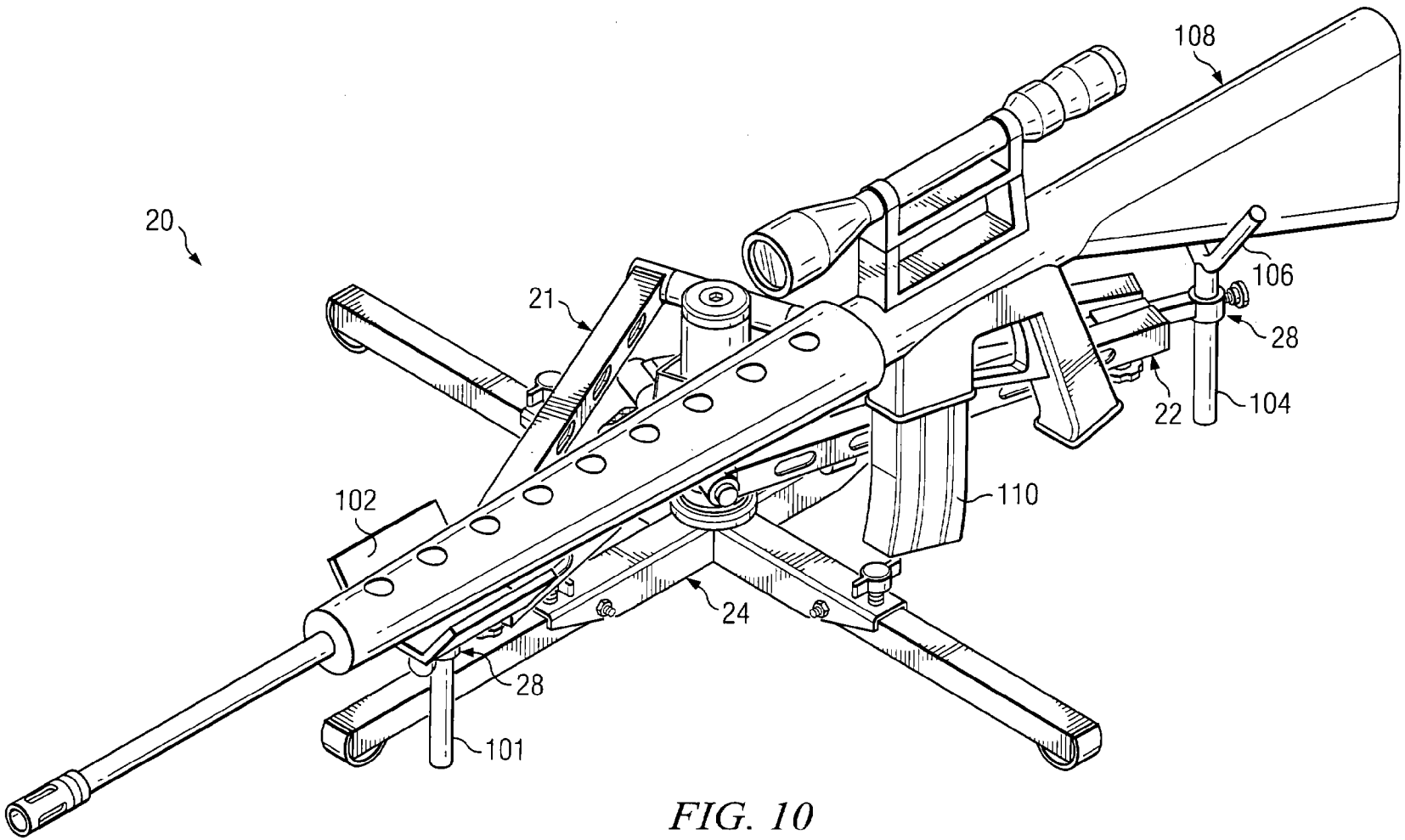
FIG. 10 is a perspective view of a fifth embodiment of the present invention.

FIG. 10 shows a perspective view of a fifth embodiment of the present invention. The fifth embodiment is essentially identical to the first embodiment, except that the distal support members 28 are different. In FIG. 10, a first distal support member 101 is attached to the distal end 34 of a first link 31 for a first arm member 21. This distal support member 101 has a trough-shaped cradle portion 102, which may be desired for accepting larger gun stocks therein. Also in FIG. 10, a second distal support member 104 is attached to the distal end 34 of a first link 31 for a second arm member 22. This distal support member 104 has a generally V-shaped cradle portion 106.

FIG. 10 shows a gun 108 having a long clip 110 on the gun rest 20 of the fifth embodiment. One of the advantages of an embodiment of the present invention is that it may be used with guns 108 having long clips or magazines 110. Many of the prior art gun rests lack the ability and versatility to be used with guns 108 having long clips 110.

Figure 11:
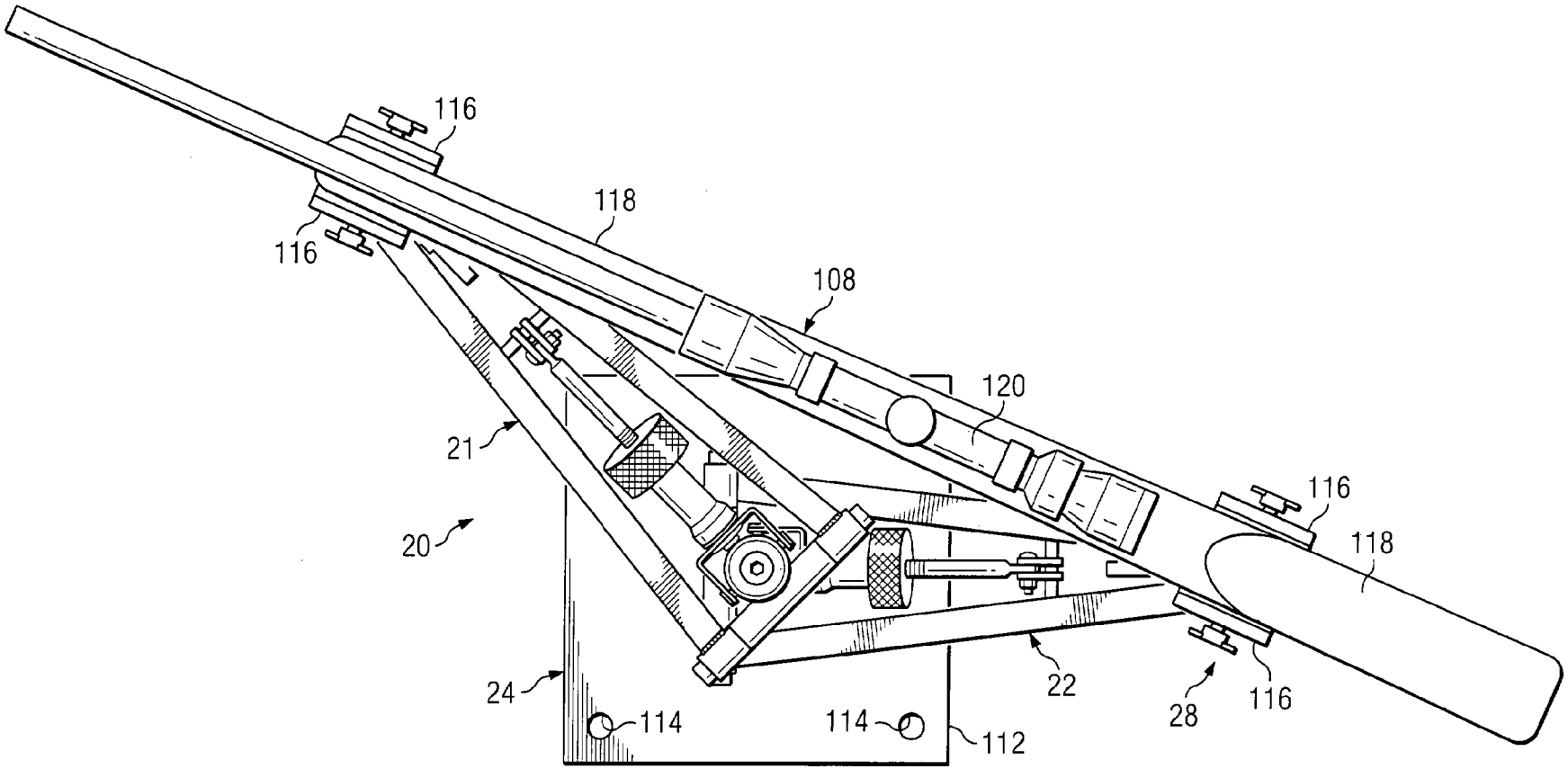
FIG. 11 is a top view of a sixth embodiment of the present invention.

FIG. 11 shows a gun rest 20 in accordance with a sixth embodiment of the present invention. This sixth embodiment is similar to the first embodiment, except that the base portion 24 and the distal support members 28 differ. As shown in FIG. 11, the base portion 24 may have a generally plate-shaped portion 112 with mounting holes 114 formed therein. Such a base portion 24 may be bolted to another object (e.g., a table, a deer stand, a tripod, a vehicle, a boat), for example. Also in another example, such a base portion 24 may be staked to the ground (i.e., driving stakes (not shown) into the ground through the mounting holes 114).

The distal support members 28 of the sixth embodiment (FIG. 11), each includes a clamp portion 116. The clamp portion 116 may be used like a vise to hold the gun stock 118 firmly in place, for example, as shown in FIG. 1. The clamp portion 116 also may be fully opened to provide a cradle for the gun 108 to rest in, rather than clamping it. The amount of clamping force exerted by the clamp members 116 may be adjusted. Knobs may be provided to allow for tool-free adjusting of the clamping force or clamp position. FIG. 11 shows a high-power hunting rifle 108 with a long-range scope 120 being retained by the gun rest apparatus 20.

Figure 12:
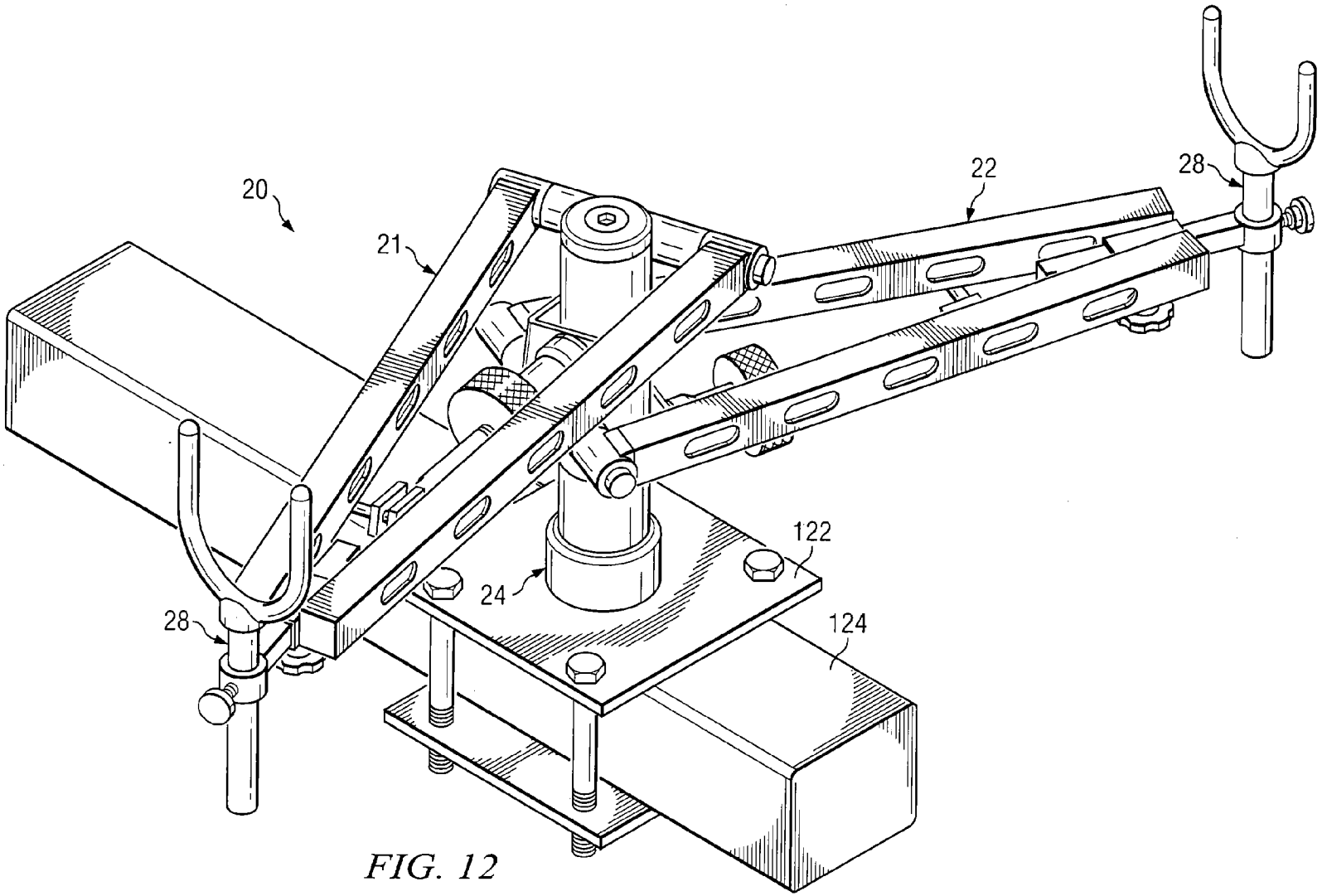
FIG. 12 is a perspective view of a seventh embodiment of the present invention.
Figure 13:
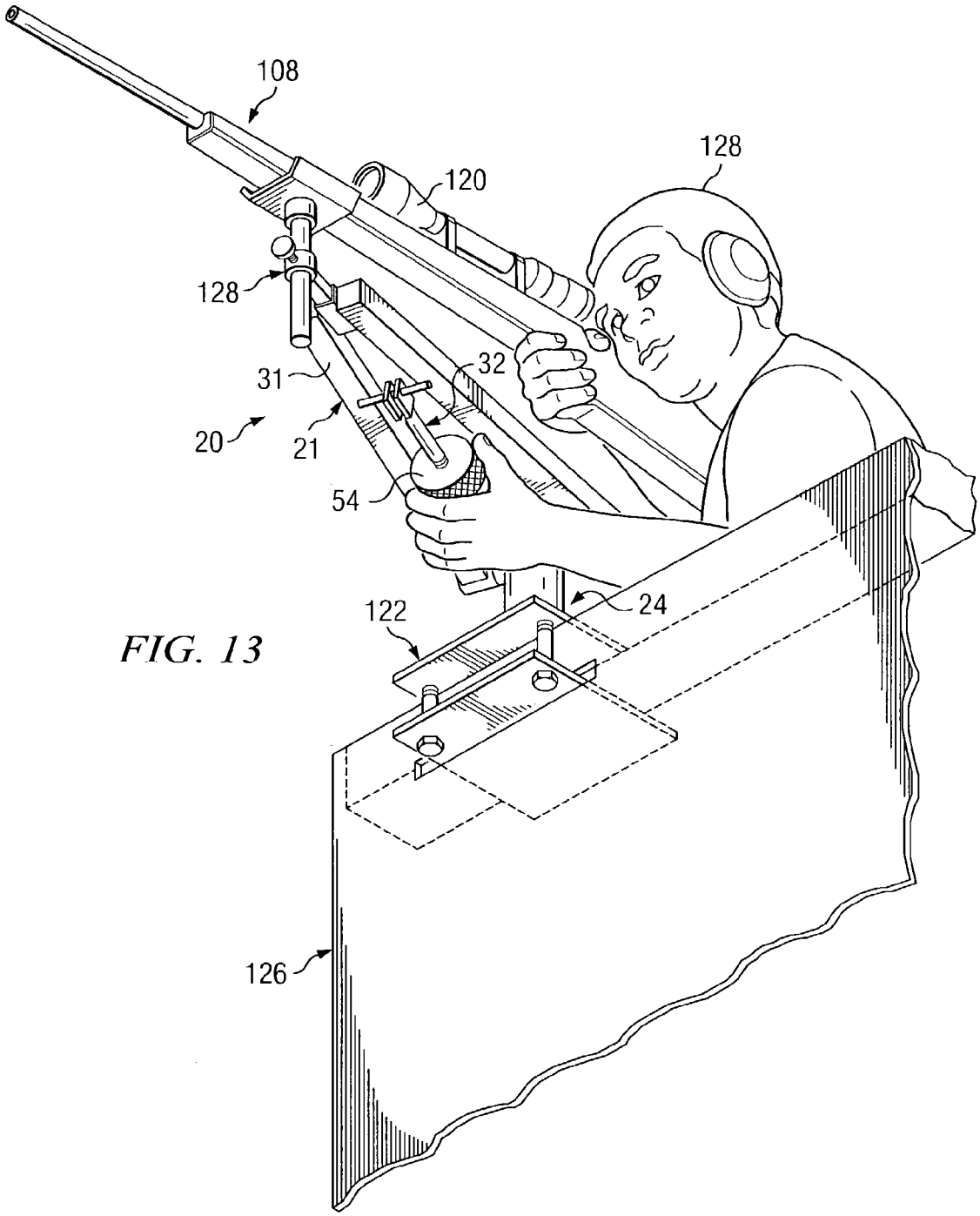
FIG. 13 is a perspective view of the seventh embodiment in use on a deer stand.

FIG. 12 shows a perspective view of a gun rest apparatus 20 in accordance with a seventh embodiment of the present invention. This seventh embodiment is similar to the first embodiment shown in FIGS. 1–3, except that the base portion 24 differs. The base portion 24 may have a bracket 122 to allow the gun rest 20 to be attached to another object. FIG. 12 shows the gun rest 20 removably attached to a rail 124. Other objects that the gun rest 20 may be attached to include, but are not limited to: a deer stand, a truck bed, a vehicle, a tree limb, a log, a trailer, a boat, a table, or a work bench, for example. FIG. 13 shows a variation of the seventh embodiment being used on a deer stand 126. Note in FIG. 13 that an embodiment of the present invention may allow the user to steady and shoot the gun 108 with one hand, while adjusting and tweaking the position of the gun rest 20 with the other hand. This is yet another advantage of the present invention. In FIG. 13, the hunter 128 is using a high-power rifle 108 with a long-range scope 120 to fire on a target far away. While keeping the target within the scope 120 and maintaining control of the gun 108, the hunter 128 may quickly, quietly, and easily fine tune his aim. These advantages, combined with the structural stability of the gun rest 20, may allow the hunter 128 to increase his shooting accuracy and provide a higher likelihood of hitting the target in the proper location.

Figure 14:
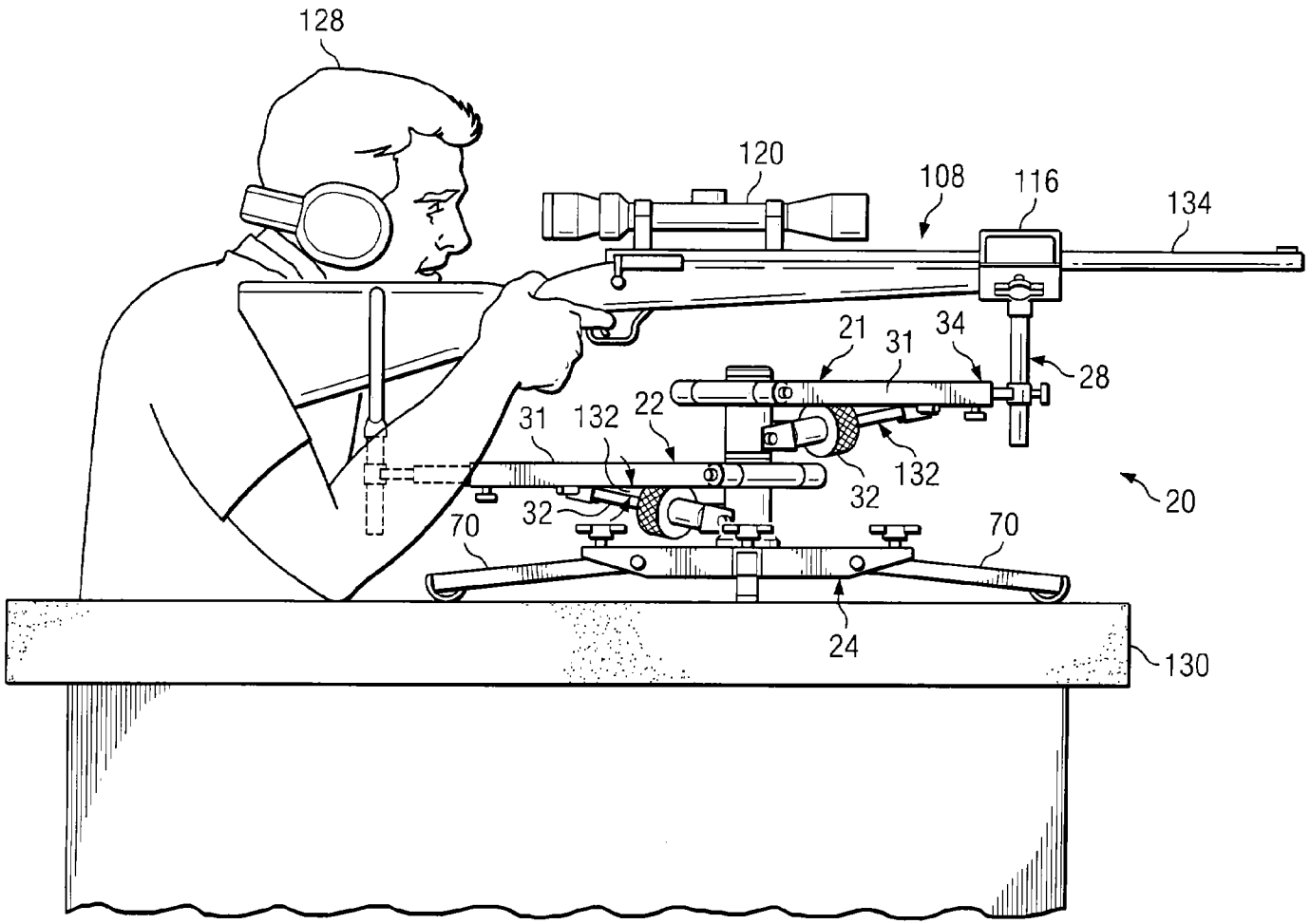
FIG. 14 is a side view of a person using an embodiment of the present invention in a seated position.

FIG. 14 shows a target shooter 128 using an embodiment of the present invention at a shooting range. Note that the shooter 128 in FIG. 14 is in a seated position and the gun rest 20 is positioned on a table 130. Because a gun 108 may be controlled and fired with one hand using an embodiment of the present invention, this invention may allow a person having use of only one hand or one arm to still enjoy firing a gun 108. A person 128 may adjust the gun rest 20 and fire the gun (sequentially) with the same hand (i.e., single handed operation and use of the gun rest 20). The ability to rely on the gun rest to retain the gun 108 and the ability to easily adjust the gun rest 20 with one hand may make hunting and/or shooting activities more accessible to disabled, injured, and/or disfigured persons. For example, a user having only one arm (e.g., a disabled veteran) may still enjoy hunting or target shooting with the use of the present invention. When the gun 108 is clamped in place on the gun rest 20 (at one or two of the distal support members 28), a person 128 may adjust the position of the gun rest 20 with one hand while the gun 108 is retained by the gun rest 20, for example. Thus, making shooting and/or hunting feasible and accessible to many disabled, injured, or disfigured persons is another advantage for an embodiment of the present invention.

Another feature of the embodiment shown in FIG. 14 is the angle 132 formed between the first link 31 and the second link 32, which is about 30 degrees in a preferred embodiment. However, this angle 132 may vary for other embodiments. Due to this configuration between the adjustable second link 32 and the first link 31, movements of the second link 32 translate into much smaller height adjustments for the distal support member 28 at the distal end 34 of the first link 31. Thus, each movement of the knob portion 54 on the second link 32 (adjusting its length) translates into minute elevation/tilt changes for a gun barrel 134 (of a gun 108 supported by the gun rest 20). This allows for minute and precise adjustments of aim for long-range targets, which is yet another advantage provided by an embodiment of the present invention. The amount of height adjustment for the distal support member 28 caused by a change in the length of the second link 32 may be varied by altering the thread pitch (e.g., shaft threads 53 in FIG. 3 and threaded hole 56 of knob 54 in FIG. 5), and/or the angle 132 formed between the first link 31 and the second link 32. Also, the diameter of the knob 54 where the user grabs and turns the knob 54 (e.g., knurled outer ring 58) may be varied to provide more or less lengthening for the second link 32 per movement of the knob 54.

Figure 15:
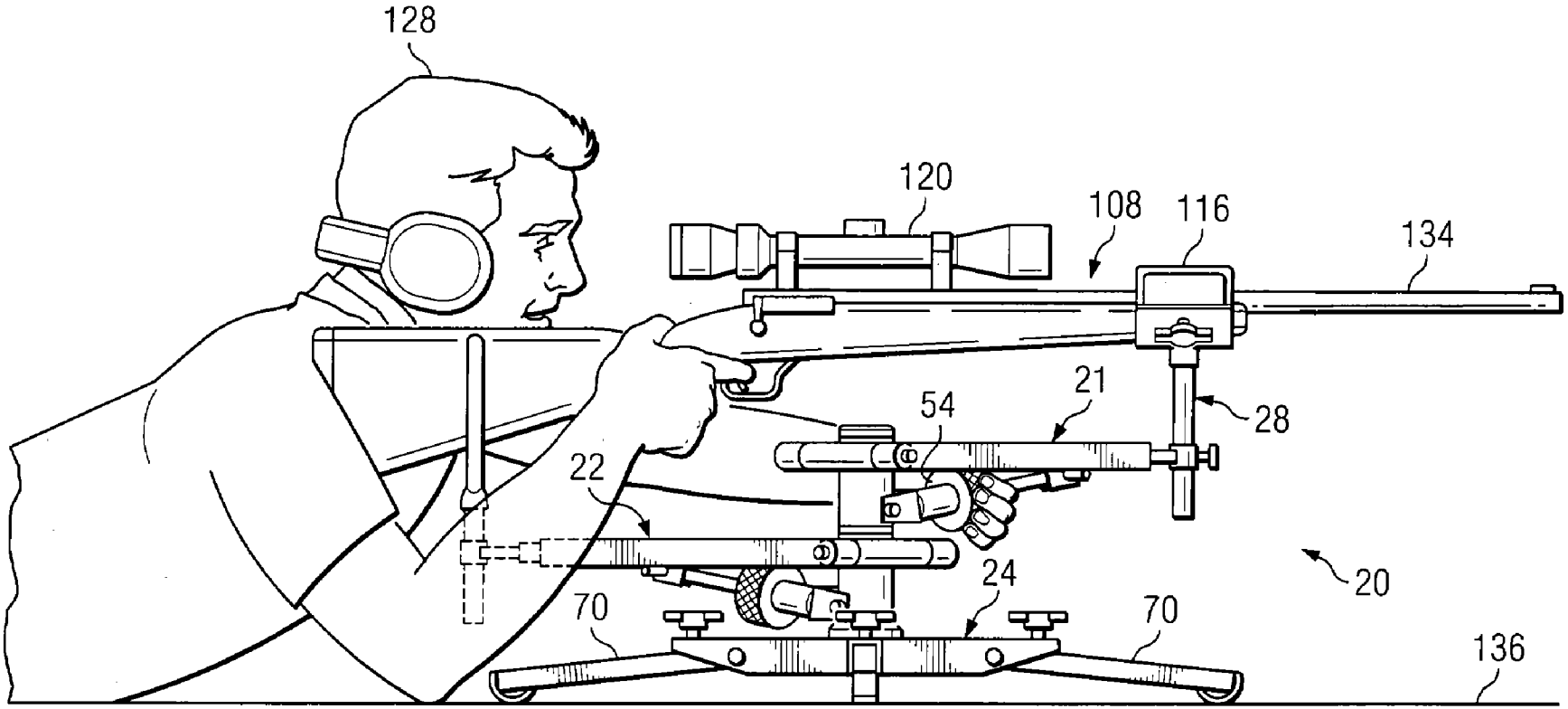
FIG. 15 is a side view of a person using an embodiment of the present invention in a prone position.
Figure 16:
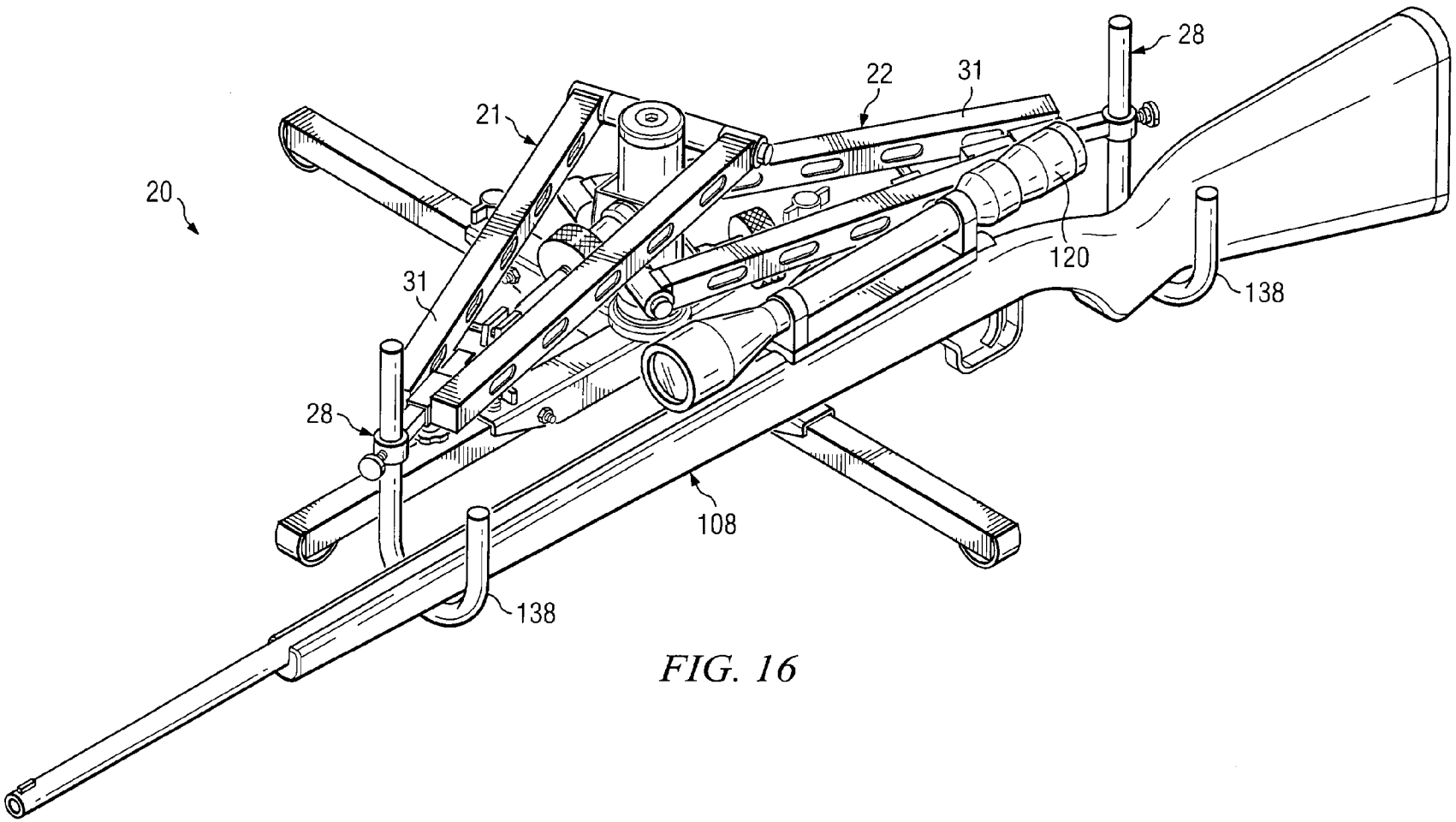
FIG. 16 is a perspective view of an eighth embodiment of the present invention.

Often while hunting or in military combat scenarios, it may be desirable to shoot a gun 108 accurately from a prone position. As shown in FIG. 15, an embodiment of the present invention may be used in a prone position while still providing a stable and precise platform for the gun 108. In some situations or activities, it is desirable to get the shooter 128 and the gun 108 as low to the ground or surface 136 as possible. FIG. 16 shows an eighth embodiment of the present invention, which provides the ability to position the gun 108 very close or on the ground/surface. The distal support members 28 may include generally J-shaped cradle portions 138 that extend below the first links 31 of the arm members 21, 22, as shown in FIG. 16.

Figure 17:
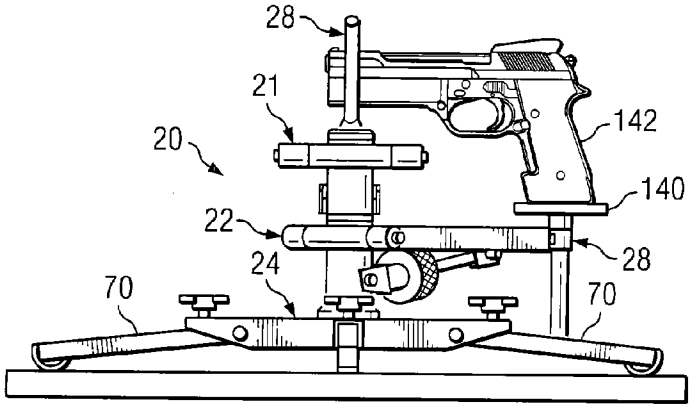
FIG. 17 is a perspective view of a ninth embodiment of the present invention.
Figure 18:
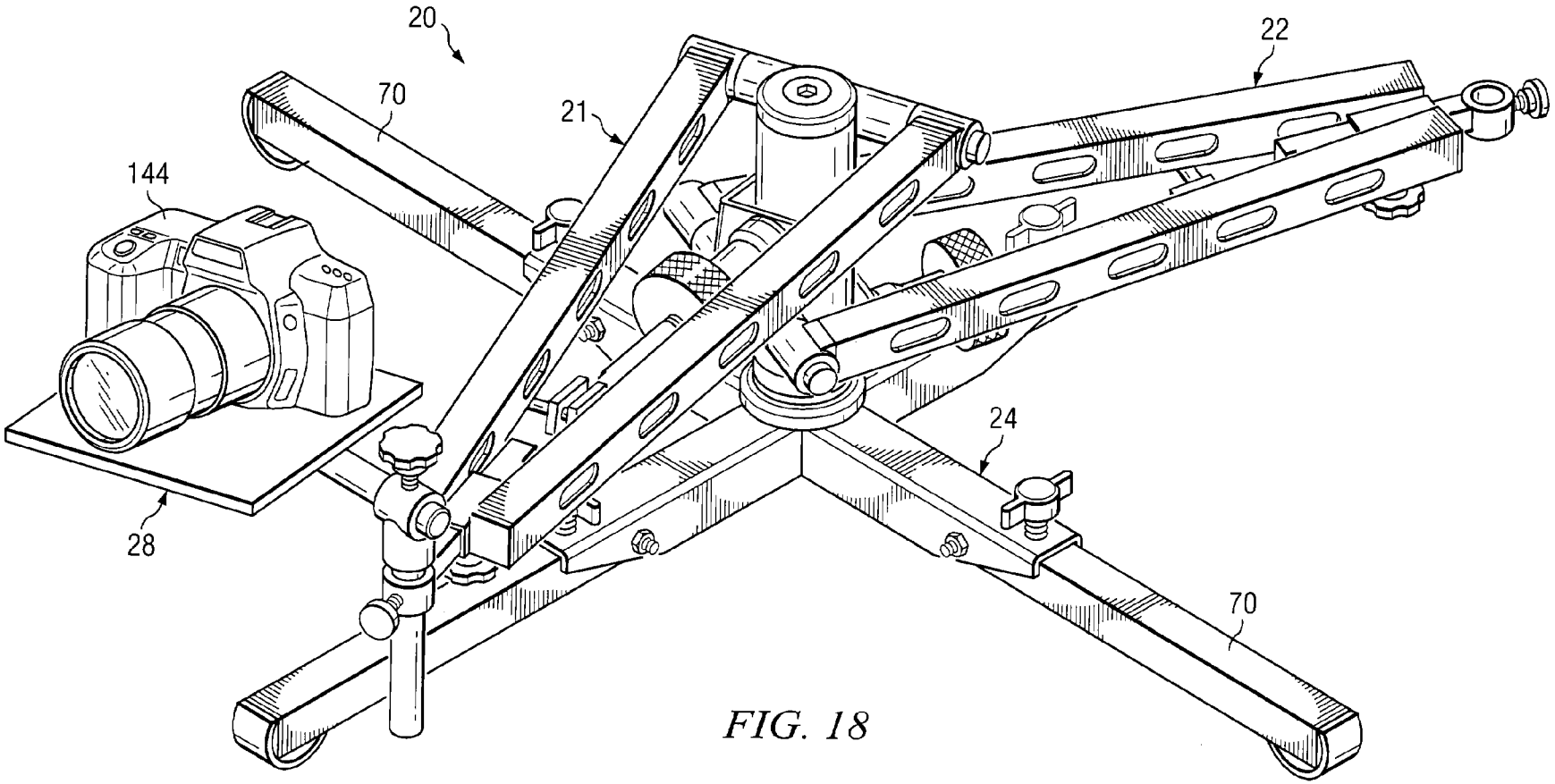
FIG. 18 is a perspective view of a tenth embodiment of the present invention.
Figure 19:
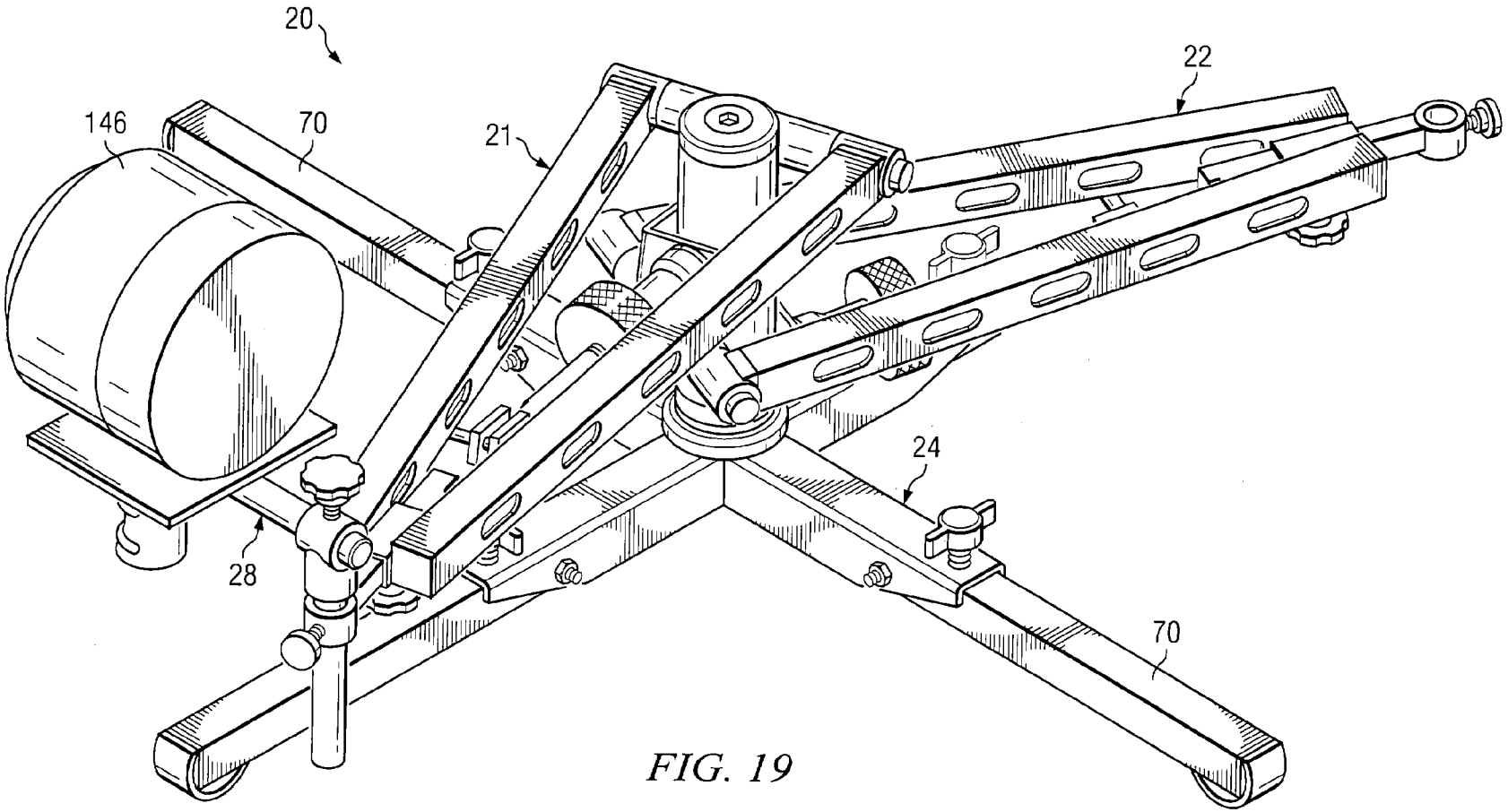
FIG. 19 is a perspective view of an eleventh embodiment of the present invention.

FIG. 17 shows a ninth embodiment of the present invention. In the ninth embodiment, one of the distal support members 28 has a platform portion 140. As shown in the FIG. 17, this embodiment may be used for supporting a pistol 142, for example. FIG. 18 shows a tenth embodiment of the present invention. In the tenth embodiment, another variation of the distal support member 28 is shown. The distal support member 28 of FIG. 18 is adapted to retain or support a camera 144 (e.g., still camera, video camera), for example. Such distal support member 28 may have mounting holes and/or mounting screws (not shown) adapted for particular camera mounting locations. Also, in another embodiment (not shown), a distal support member may have an interior shape formed to match the contours or shape of a particular camera. Note that the multiple adjustment points on the distal support member 28 shown in FIG. 18 allow for multi-axis adjustments. FIG. 19 shows an eleventh embodiment of the present invention. As shown in FIG. 19, a distal support member 28 of this embodiment may be adapted to retain or support a light 146 (e.g., a spot light).

Figure 20:
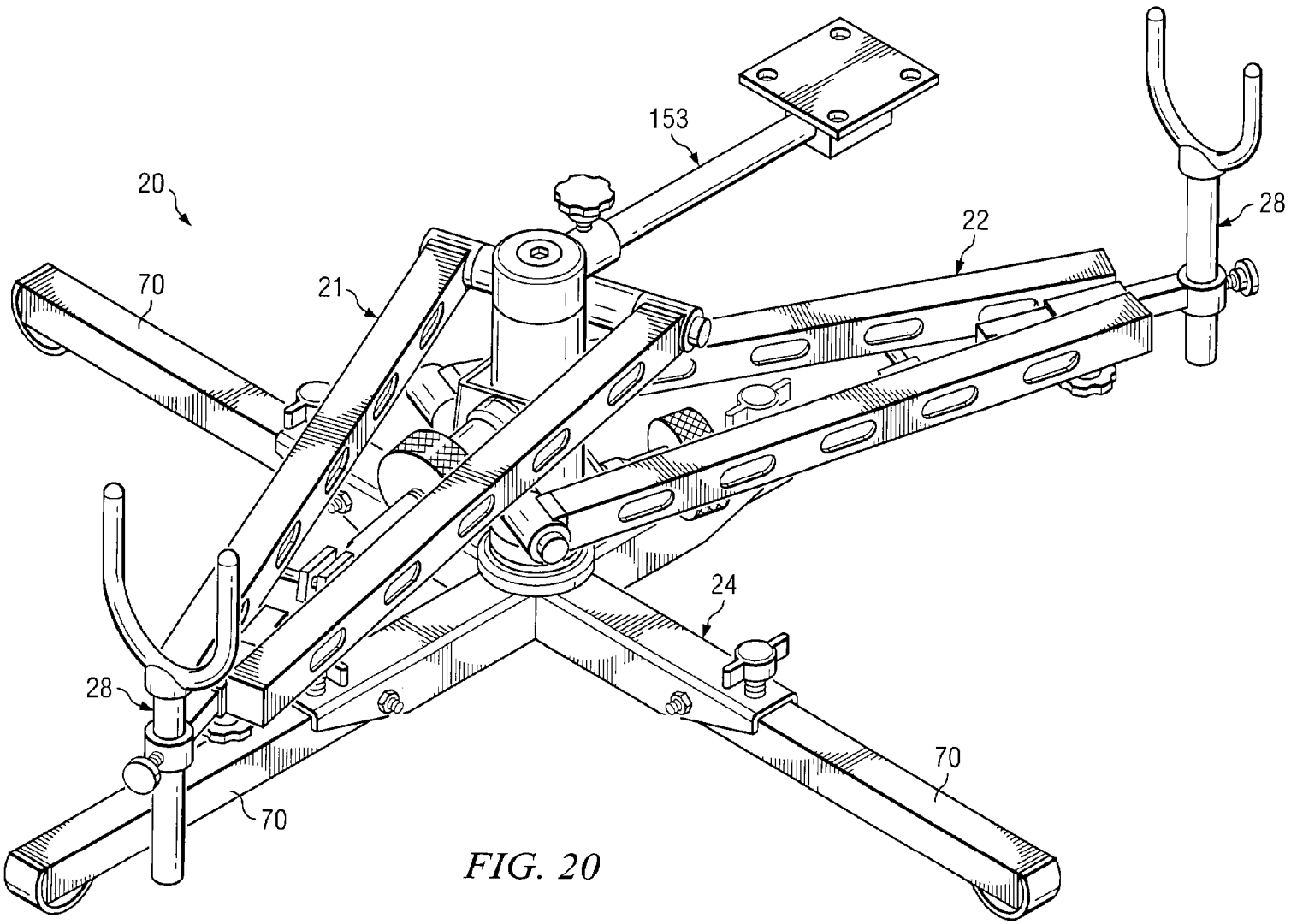
FIG. 20 is a perspective view of a twelfth embodiment of the present invention.

FIG. 20 shows a twelfth embodiment of the present invention. In this embodiment, a third arm member 153 is added. The third arm member 153 shown in FIG. 20 differs from the first and second arm members 21, 22. In other embodiments, however, a third arm member 153 may be identical to the first and second arm members 21, 22. Also, an embodiment of the present invention may have a larger numbers of arm members (e.g., four, five, etc.). The third arm member 153 may be used to support other objects (e.g., still camera, video camera, spot light, support tray), for example.

Figure 21:
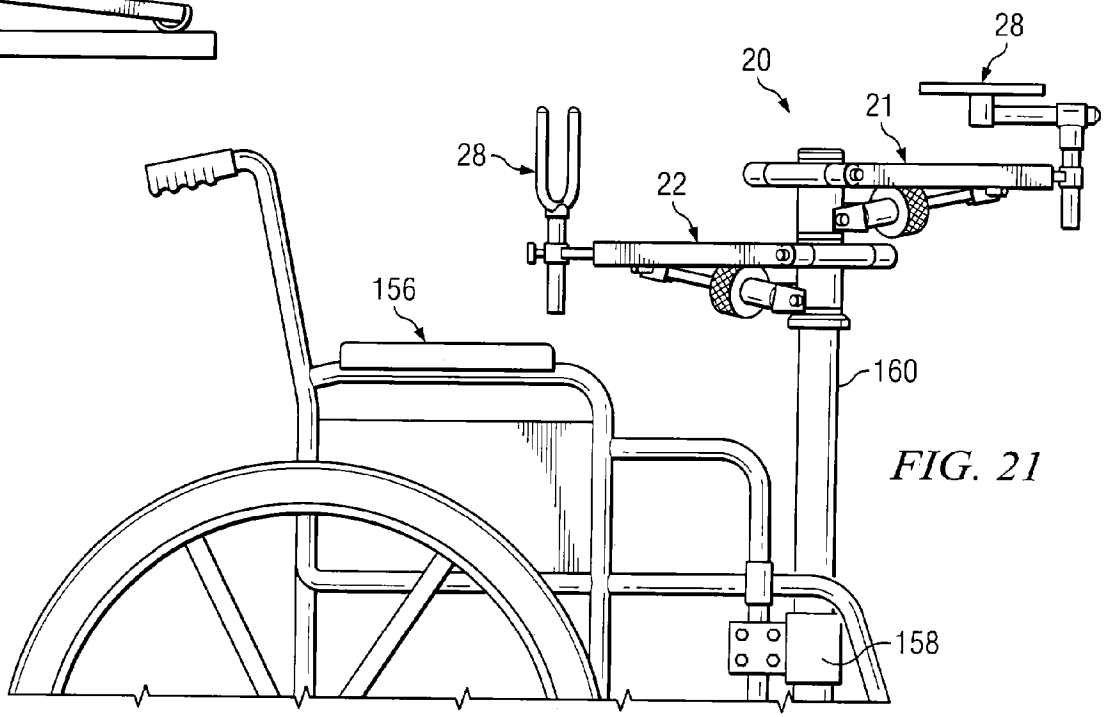
FIG. 21 is a perspective view of a thirteenth embodiment of the present invention.

FIG. 21 shows a thirteenth embodiment of the present invention. The base portion 24 of this embodiment is adapted to be attached to a wheelchair 156. As shown in FIG. 21, the base portion 24 may include a bracket 158 that removably attaches to a wheelchair frame. An upright post portion 160 of the base portion 24 may extend on either side of the wheelchair 156 (e.g., on left or right side of person seated in wheelchair 156), or it may extend from the middle region of the wheelchair 156 (e.g., extending between the legs of a person seated in wheelchair 156). The location of the upright post portion 160 may be adjustable from side-to-side and/or vertically to provide for more versatility. The first and/or second arm members 21, 22 may be pivotably adjustable relative to the upright post portion 160, and/or vertically adjustable relative to the bracket 158. Thus, an embodiment of the present invention may provide access to hunting and shooting sports for handicapped persons.

Figure 22:
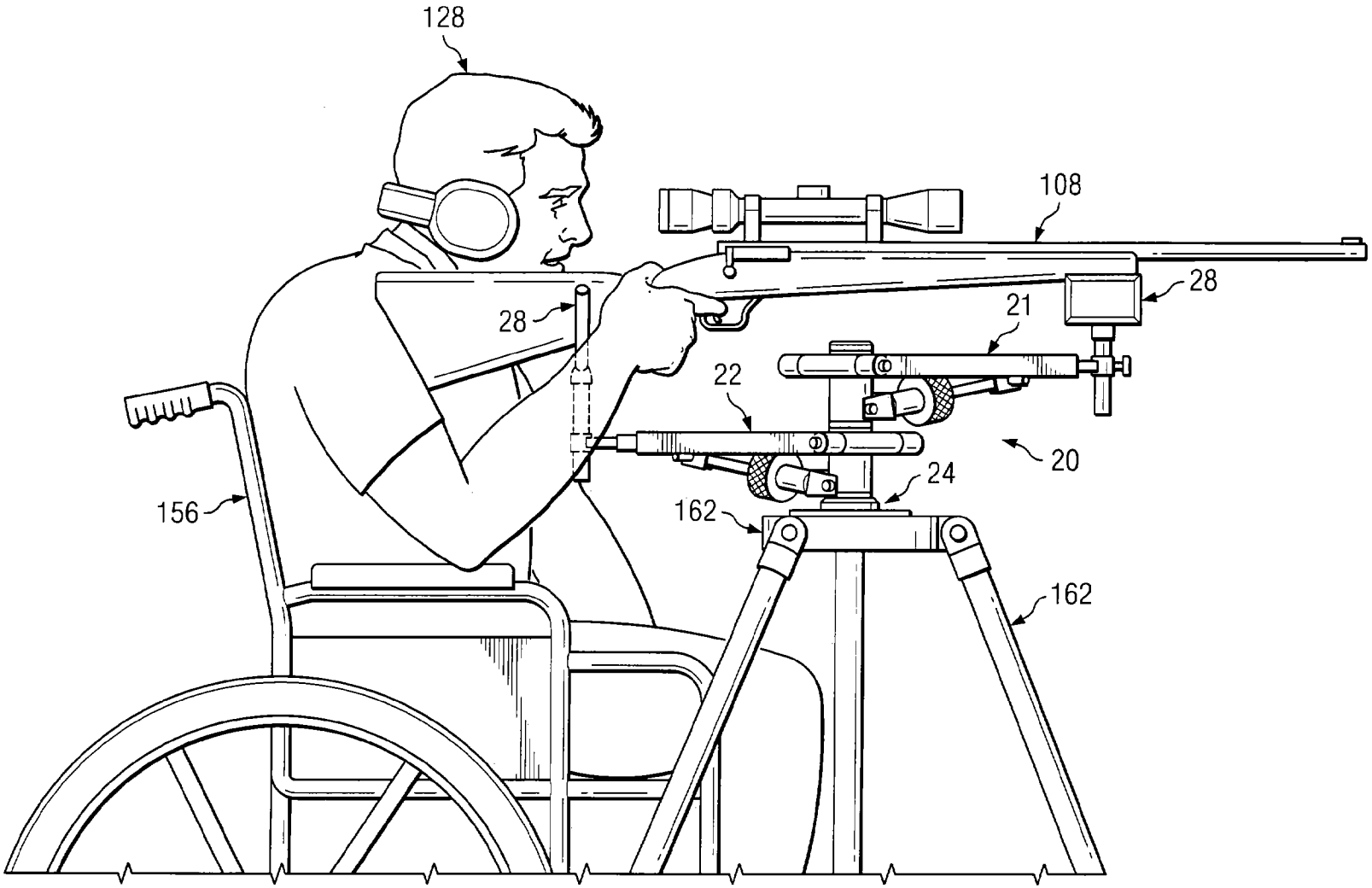
FIG. 22 is a perspective view of a fourteenth embodiment of the present invention.

FIG. 22 shows another way that a person 128 in a wheelchair 156 may use an embodiment of the present invention. In the fourteenth embodiment shown in FIG. 14, the base portion 24 includes a tripod stand 162. The person 128 in the wheelchair 156 may position his wheelchair 156 next to the gun rest 20 (and vice versa) to provide comfortable and versatile shooting positions. The gun rest 20 may be relied upon to support and/or retain the gun 108, and hence the strength of the person 128 becomes less important. Also, as shown in FIG. 22, the gun rest 20 may allow for single handed operation. The legs of the tripod stand 162 may have adjustable lengths (e.g., telescopic legs).

Figure 23:
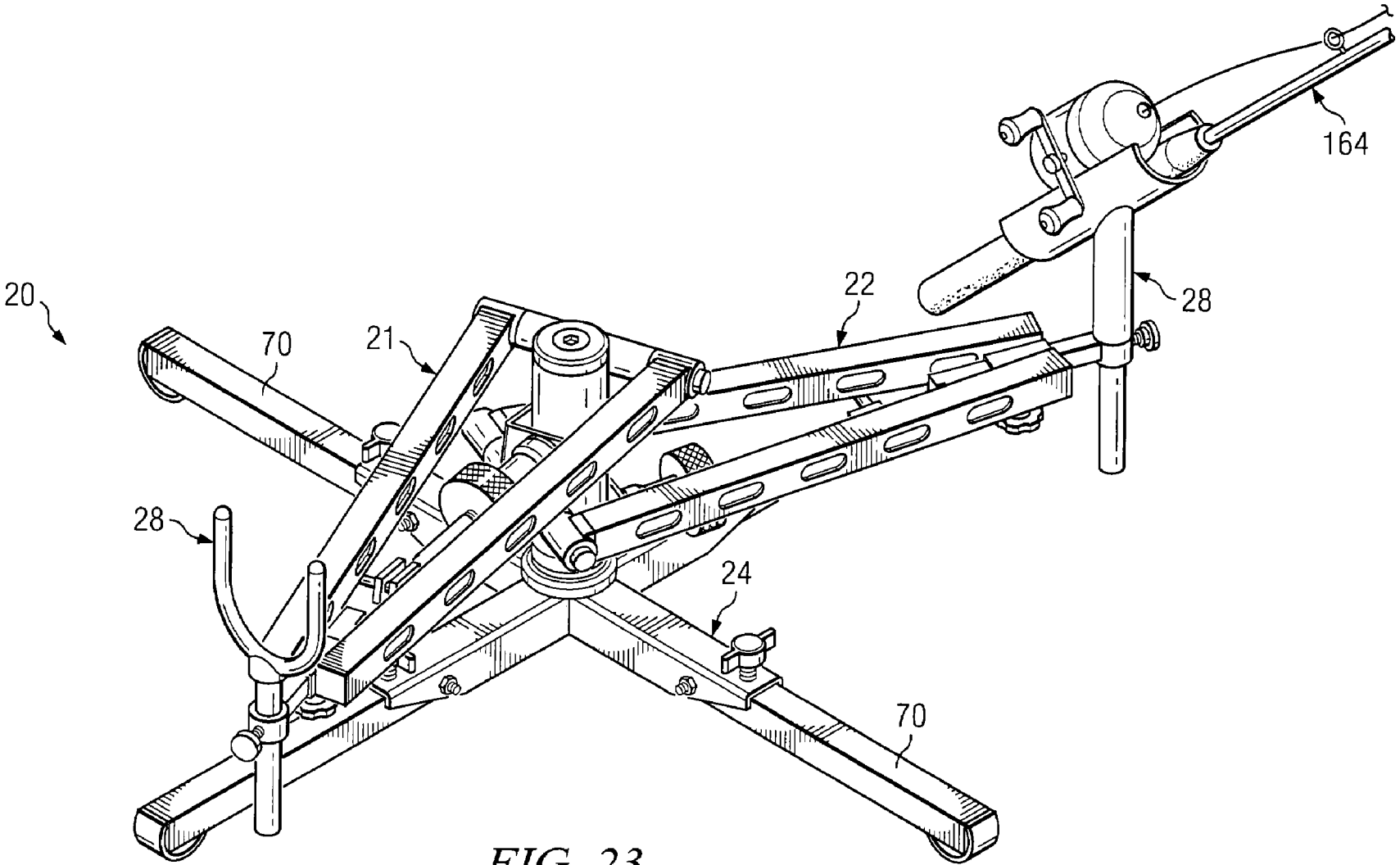
FIG. 23 is a perspective view of a fifteenth embodiment of the present invention.
Figure 24:
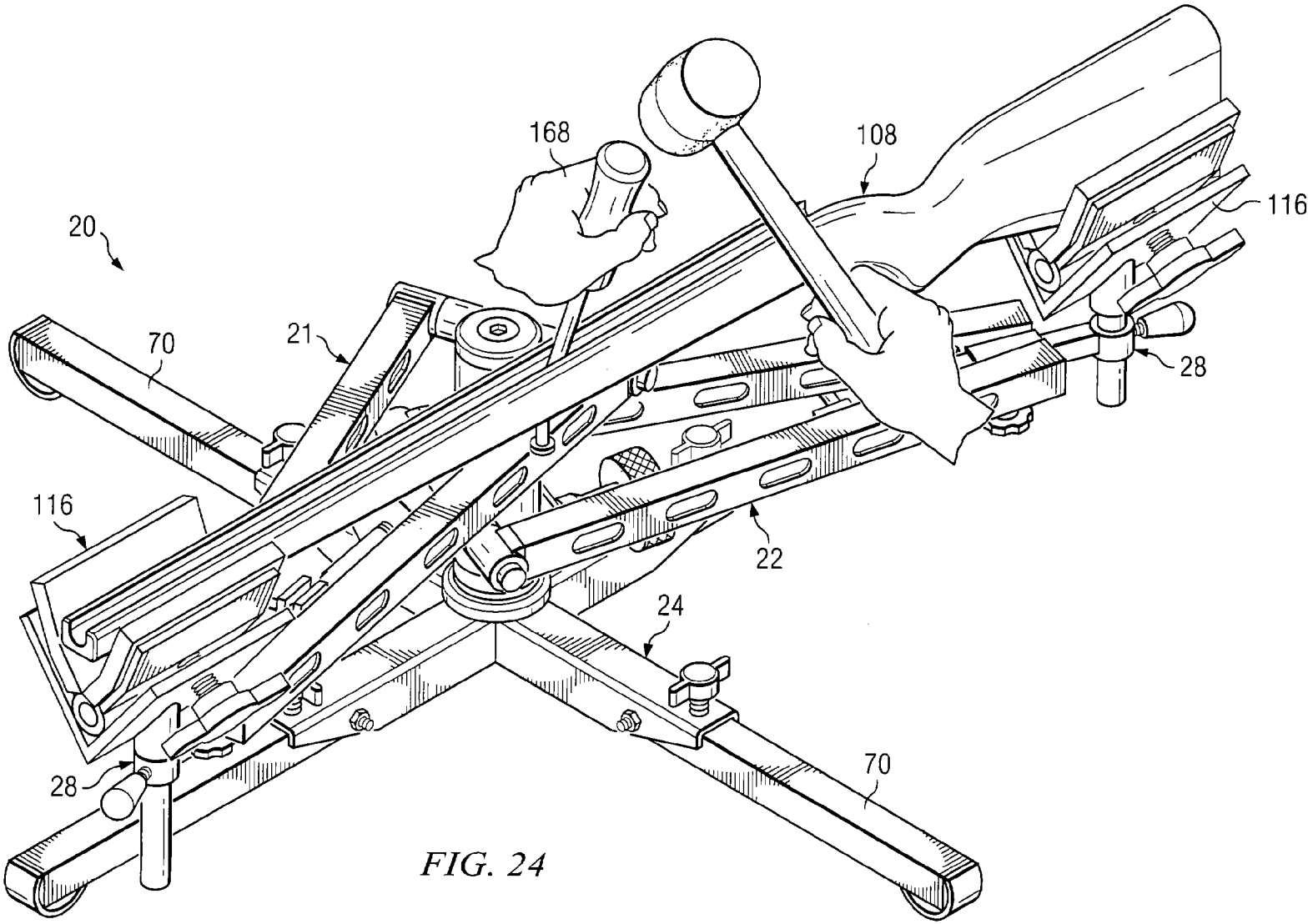
FIG. 24 is a perspective view of an embodiment of the present invention being used by a gunsmith.
Figure 25:
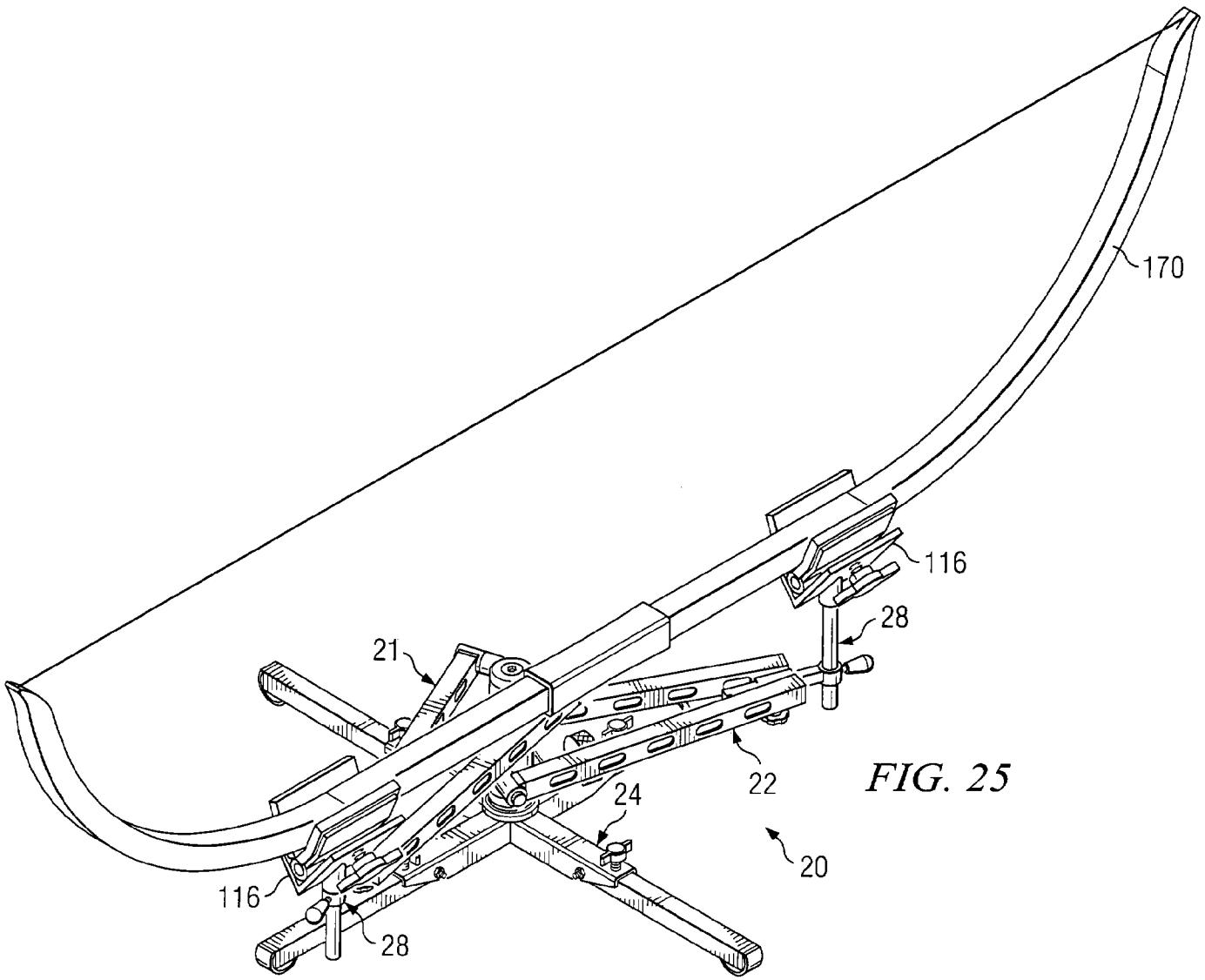
FIG. 25 is a perspective view of an embodiment of the present invention being used to hold a bow.
Figure 26:
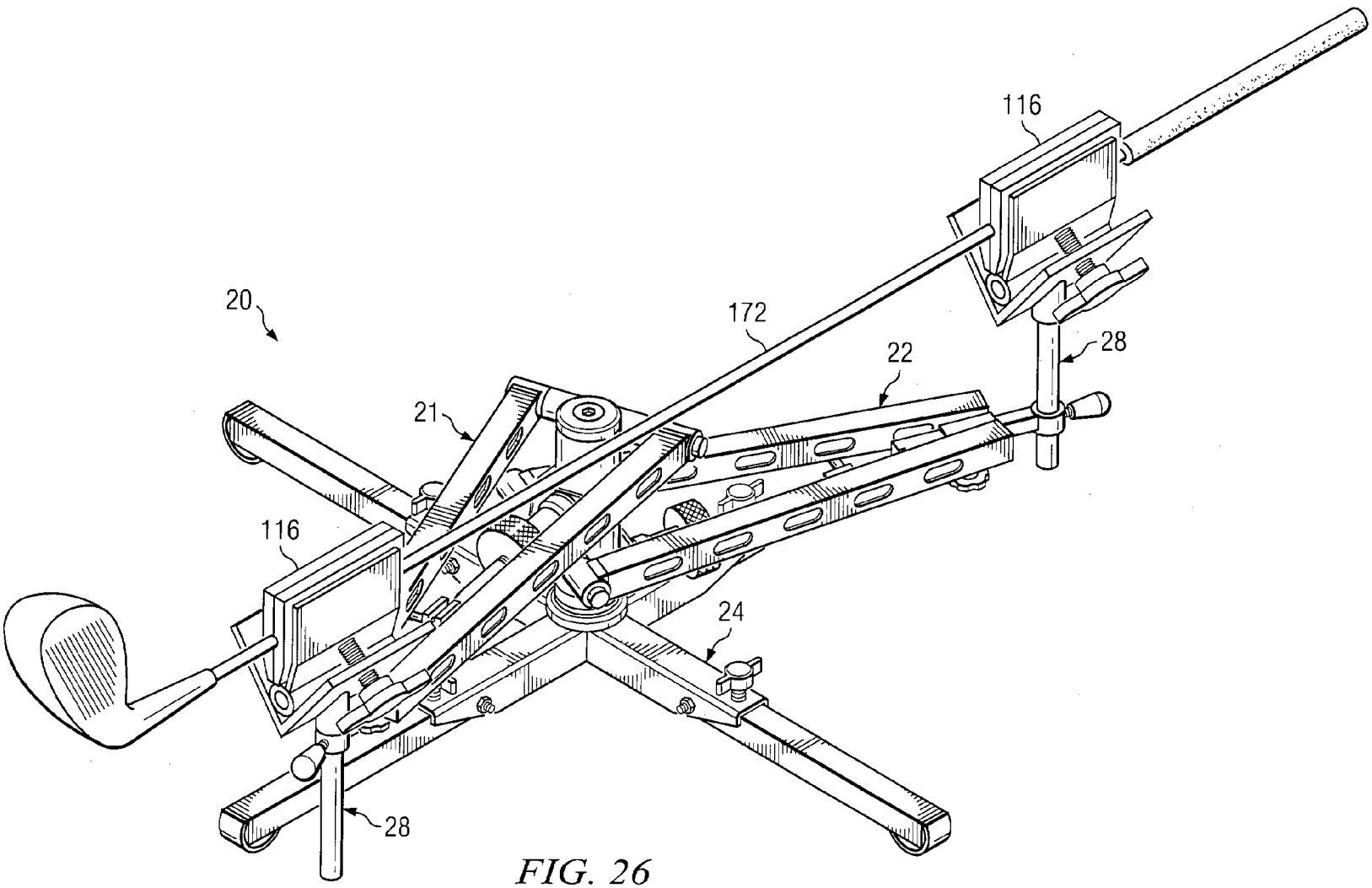
FIG. 26 is a perspective view of an embodiment of the present invention being used to hold a golf club.
Figure 27:
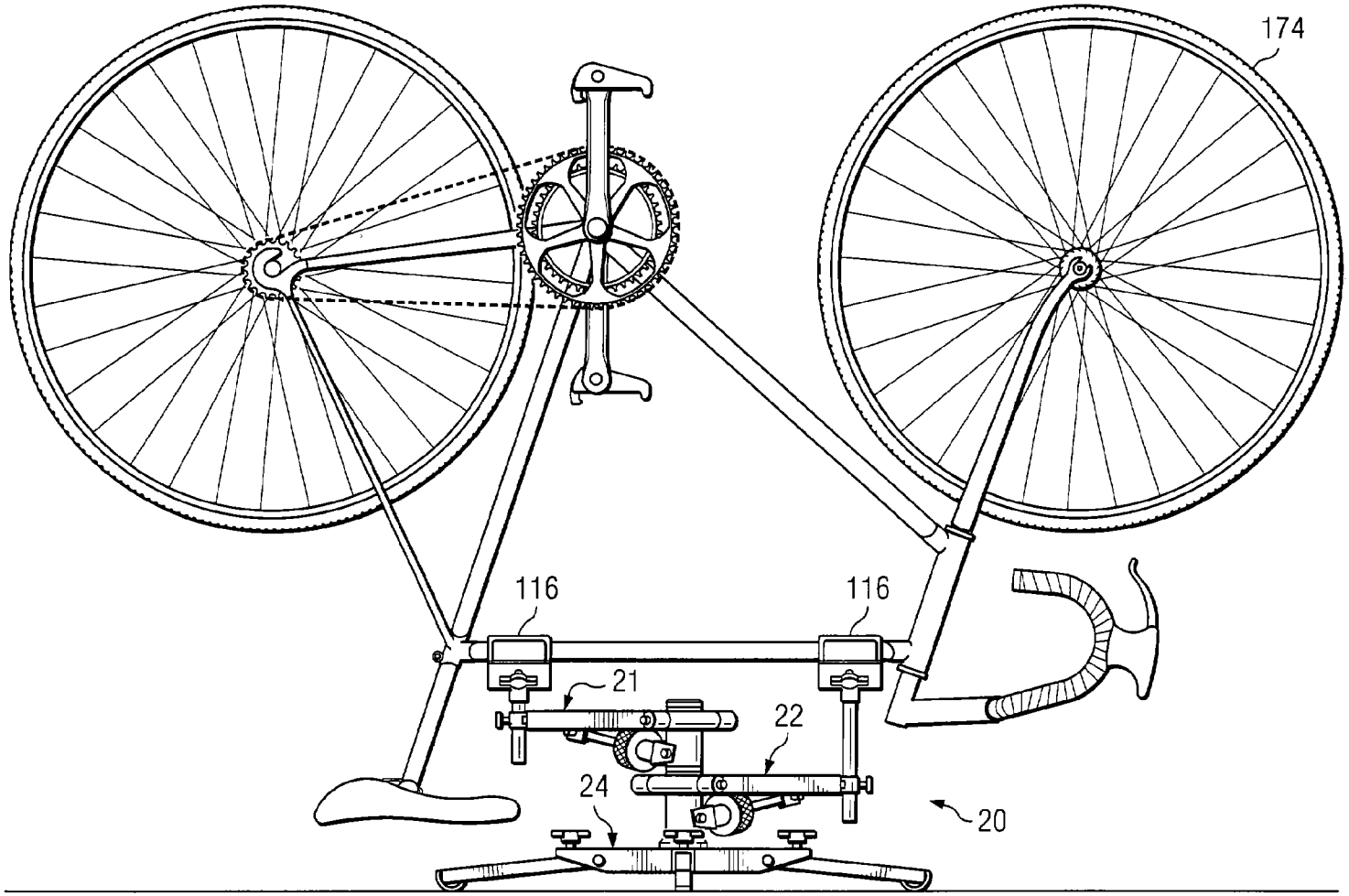
FIG. 27 is a perspective view of an embodiment of the present invention being used to hold a bicycle.

An embodiment of the present invention may have many other uses, in addition to or in alternative to holding a gun 108 while shooting the gun 108. FIG. 23 shows a fifteenth embodiment of the present invention. In the fifteenth embodiment, one of the distal support members 28 may be adapted to retain or support a fishing pole 164 (e.g., rod and reel), for example. As another example use, an embodiment of the present invention may be used by gunsmith 168 while working on a gun 108, as shown in FIG. 24. FIG. 25 shows an embodiment of the present invention being used to retain a bow 170 while working on the bow 170, for example. FIGS. 26 and 27 show an embodiment of the present invention being used to retain a golf club 172 and a bicycle 174, respectively, for example. With the benefit of this disclosure, a person will likely realize many other uses for an embodiment of the present invention. Hence, an advantage of the present invention is that an embodiment may have multiple uses, which further enhances its versatility.

Figure 28:
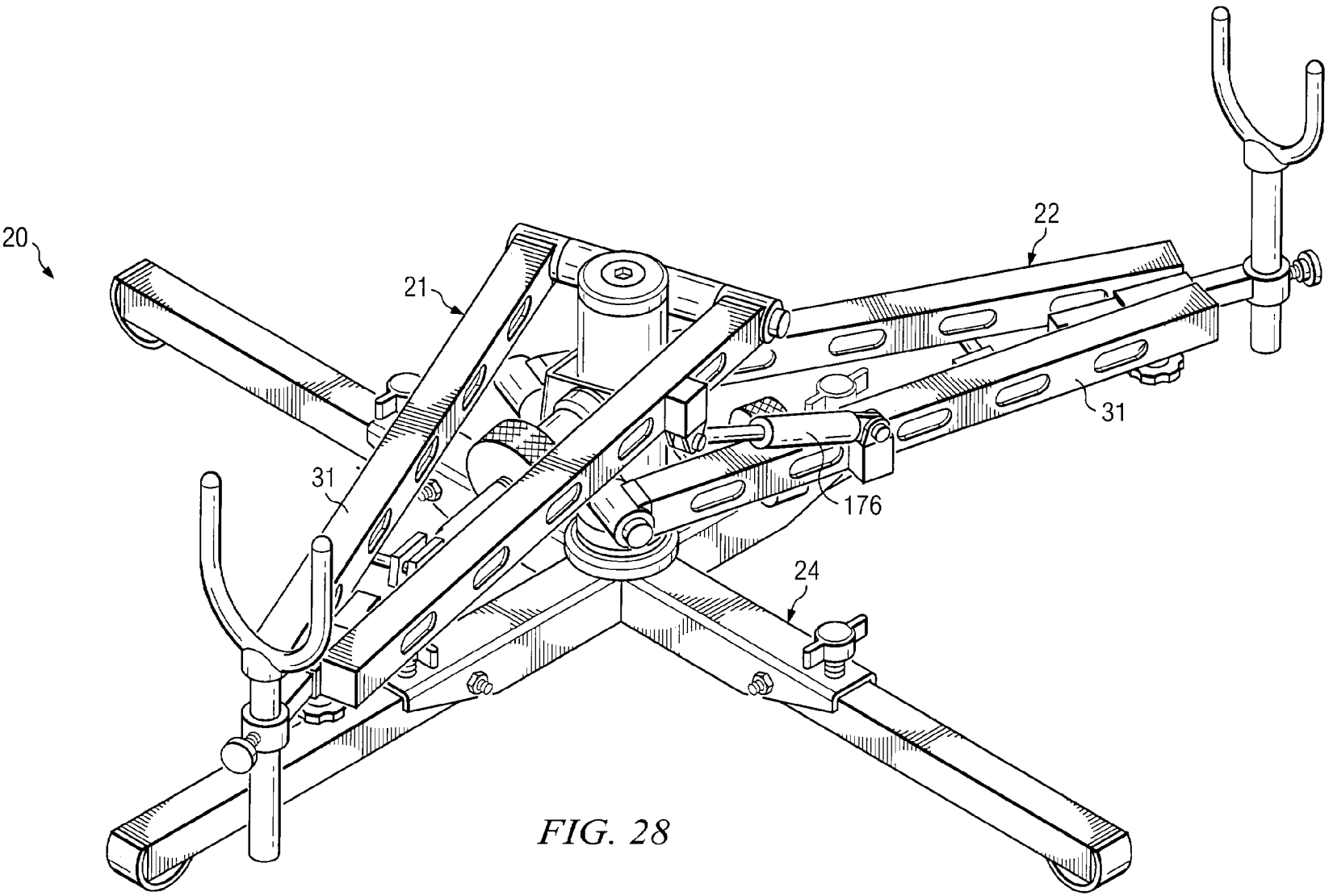
FIG. 28 is a perspective view of a sixteenth embodiment of the present invention.

FIG. 28 shows a perspective view for a sixteenth embodiment of the present invention. In this embodiment, a dampener or shock absorber 176 may be attached between the first and second arm members 21, 22 (see e.g., FIG. 28). The dampener 176 (e.g., urethane cushioned, gas charged, and/or hydraulic/oil filled) may be permanently or removably attached to one or both of the arm members 21, 22. Preferably, the dampener 176 is removably and adjustably attached to both arm members 21, 22. An end of the dampener 176 may be attached to an arm member 21, 22 in many different locations to allow for many different configurations of the arm members 21, 22 relative to each other. An end of the dampener 176 may be clamped to a first link 31 of an arm member 21, 22, for example. Also, an arm member 21, 22 may have multiple attachment holes (not shown) formed along its length to provide for multiple attachment locations for an end of the dampener 176, as another example. The dampener 176 may absorb shocks and/or vibrations to and/or from the gun, such as recoil when the gun is fired, to enhance stability.

Figure 29:
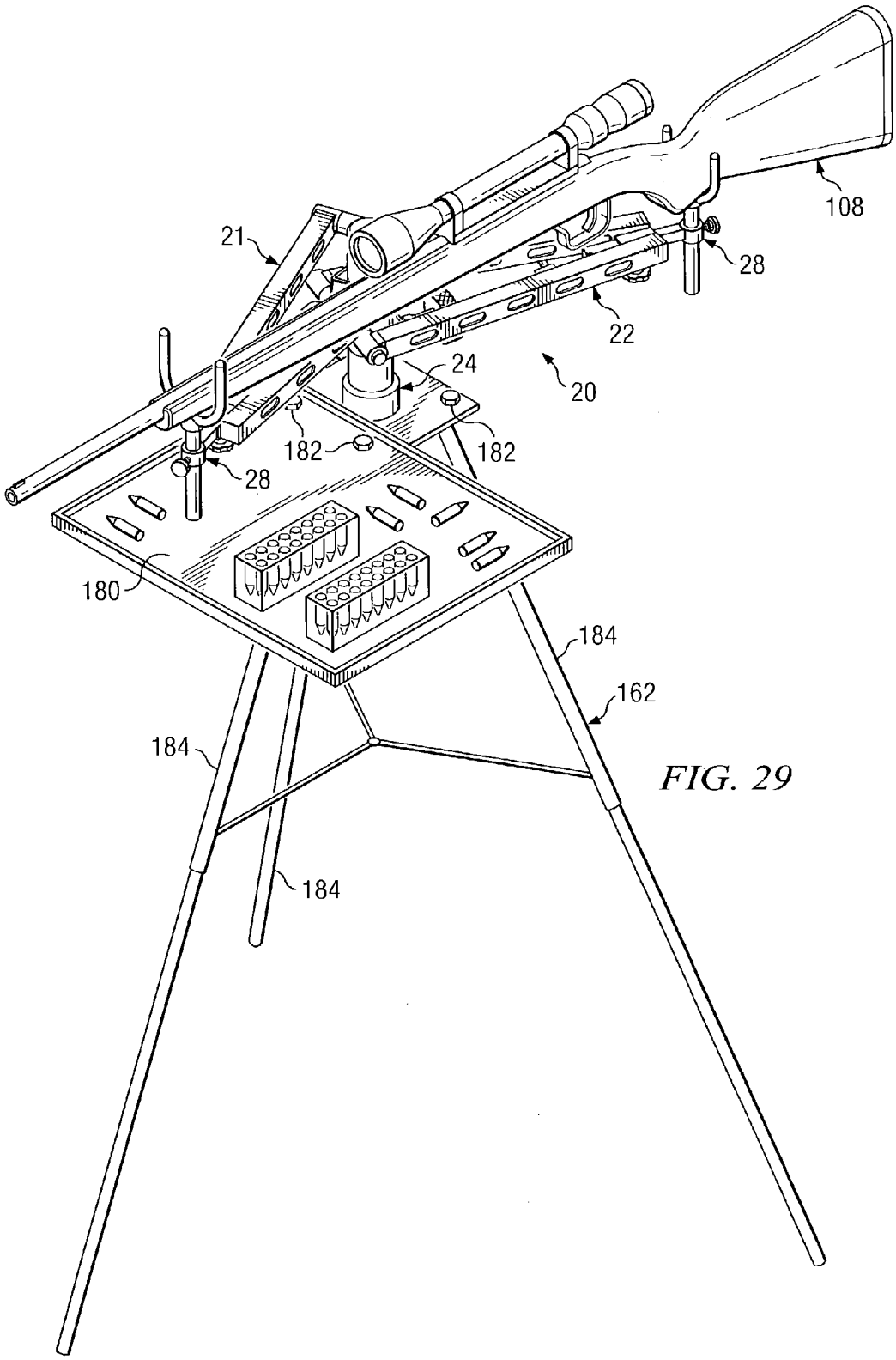
FIGS. 29–31 show variations of a seventeenth embodiment of the present invention.
Figure 30:
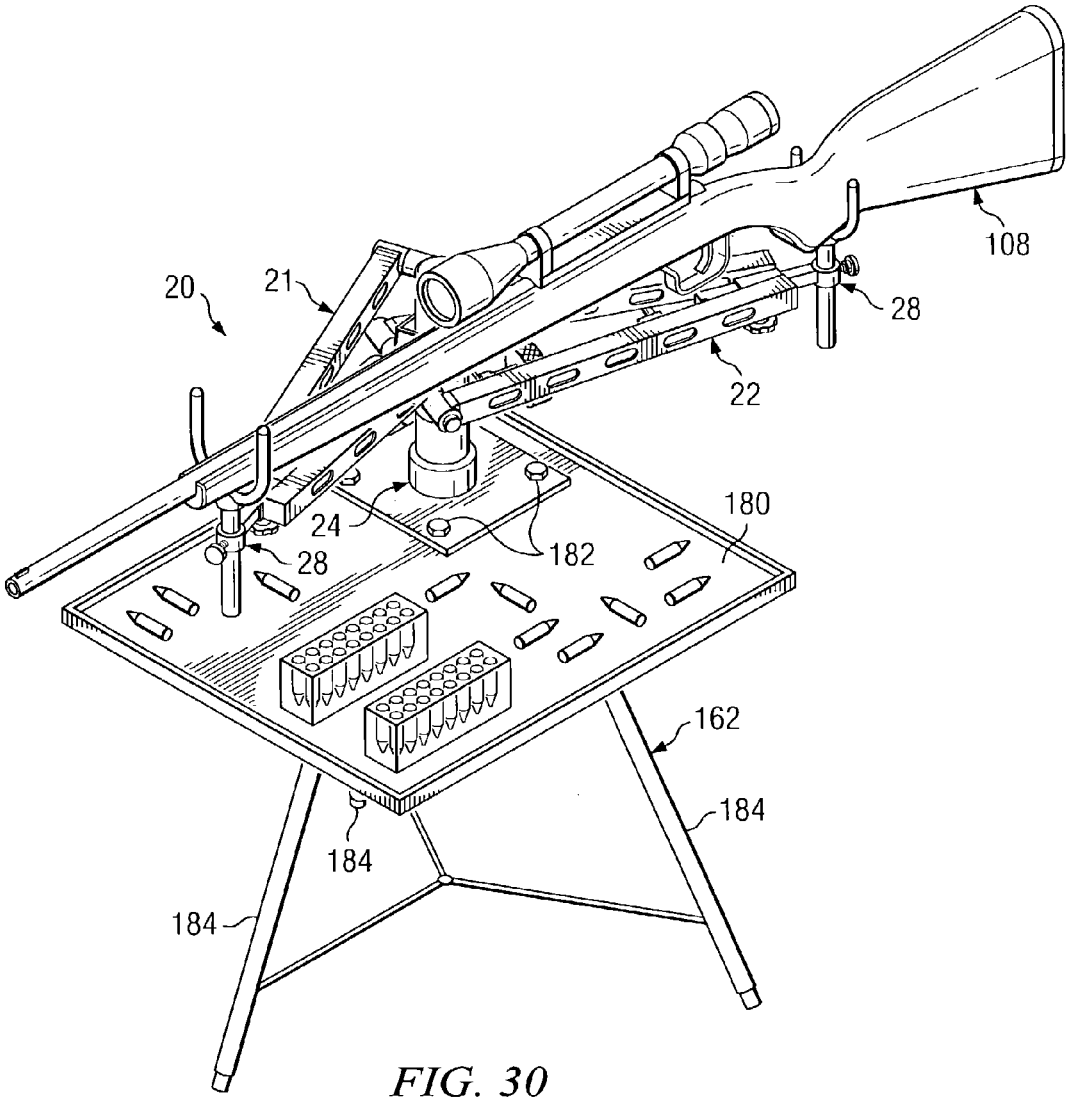
Figure 31:
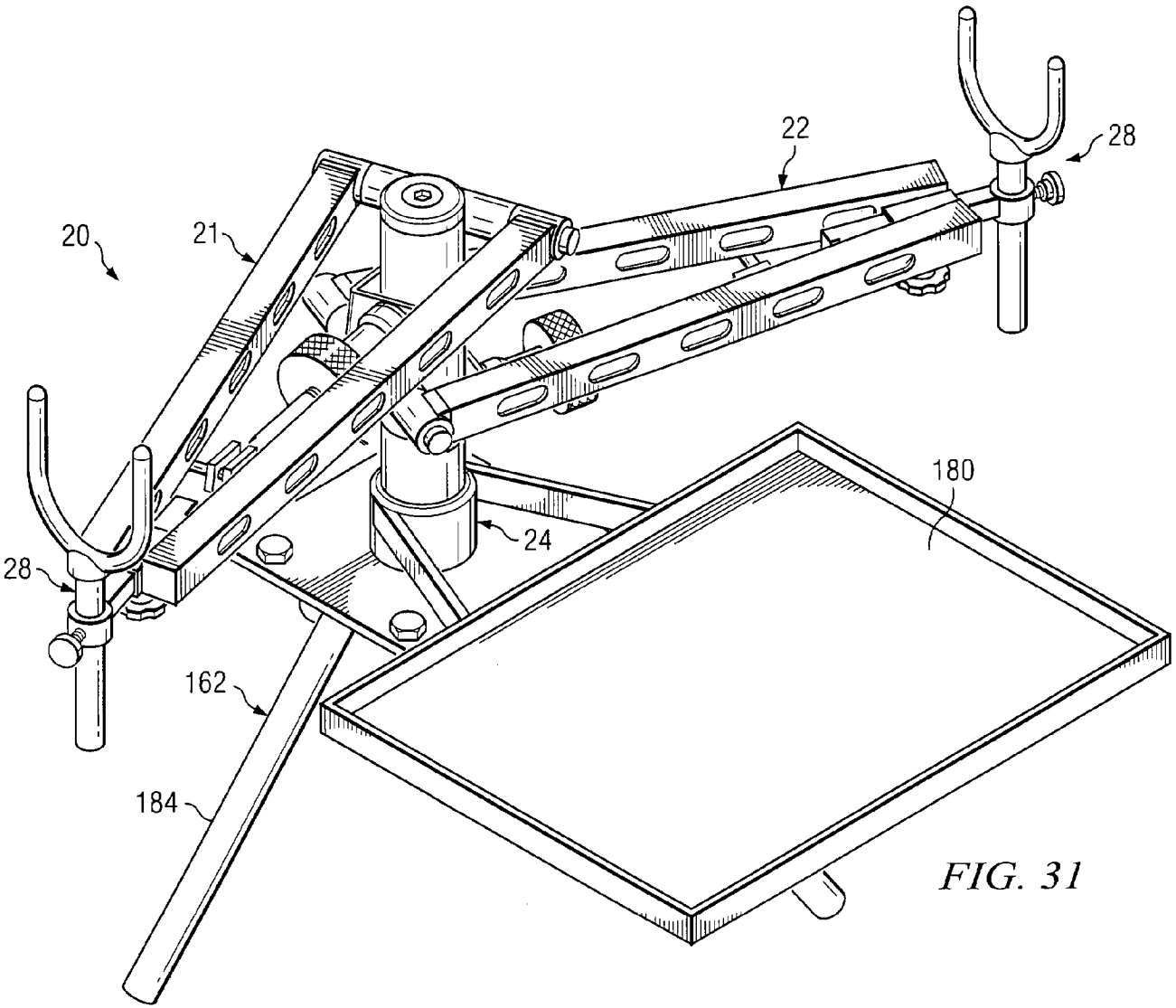

FIGS. 29–31 show a seventeenth embodiment of the present invention. In this embodiment, a storage tray 180 may be attached to and extend from the base portion 24. In FIG. 29, for example, the storage tray 180 is bolted to the base portion 24 using the same bolts 182 that retain a tripod stand portion 162. The tripod stand portion 162 may have adjustable-length legs, such as the telescopic legs 184 shown in FIG. 29. The legs 184 of the tripod portion 162 are shown in an extended configuration in FIG. 29, which may be desired when the user is standing. As also shown in FIG. 29, the storage tray 180 may be useful for retaining miscellaneous items (e.g., bullets, hearing protection, sunglasses, keys, animal calling devices, a scent bottle, cigarettes, a knife, a pistol, a drink, lunch, a map, a cell phone, a GPS device, a communication radio, spare targets, etc.), for example. Thus, a storage tray 180 may provide a desirable and useful feature or option to the gun rest 20.

FIG. 30 shows an alternative placement of the storage tray 180. In this example, the tray 180 is sandwiched between the tripod portion 162 and the remainder of the gun rest 20. Again, the tray 180 may be held in place by the same bolts 182 used to retain the tripod portion 162. The legs 184 of the tripod 162 are shown in a retracted configuration in FIG. 30, which may be desired when a user is sitting in a chair, sitting on the ground, or kneeling on the ground, for example.

FIG. 31 shows yet another way to attach the tray 180 to the base portion 24. The tray 180 may be pivotably coupled to the base portion 24, similar to the way an arm member (e.g., 21, 22, or 153) may be attached to the base portion 24. Hence, the tray 180 of FIG. 31 may pivot about the base portion 24 to change its position as desired. Although shown with a base portion 24 including a tripod stand 162 in FIGS. 29–31, a storage tray 180 may be incorporated into any embodiment of the present invention. In other embodiments (not shown), a storage tray 180 may be attached to the base portion 24 via one or more of the arm members (e.g., 21, 22, 153), for example (i.e., attached directly to an arm member). Also in other embodiments (not shown), the tray may have a cover, the tray may be deeper, or both, for example.

Figure 32:
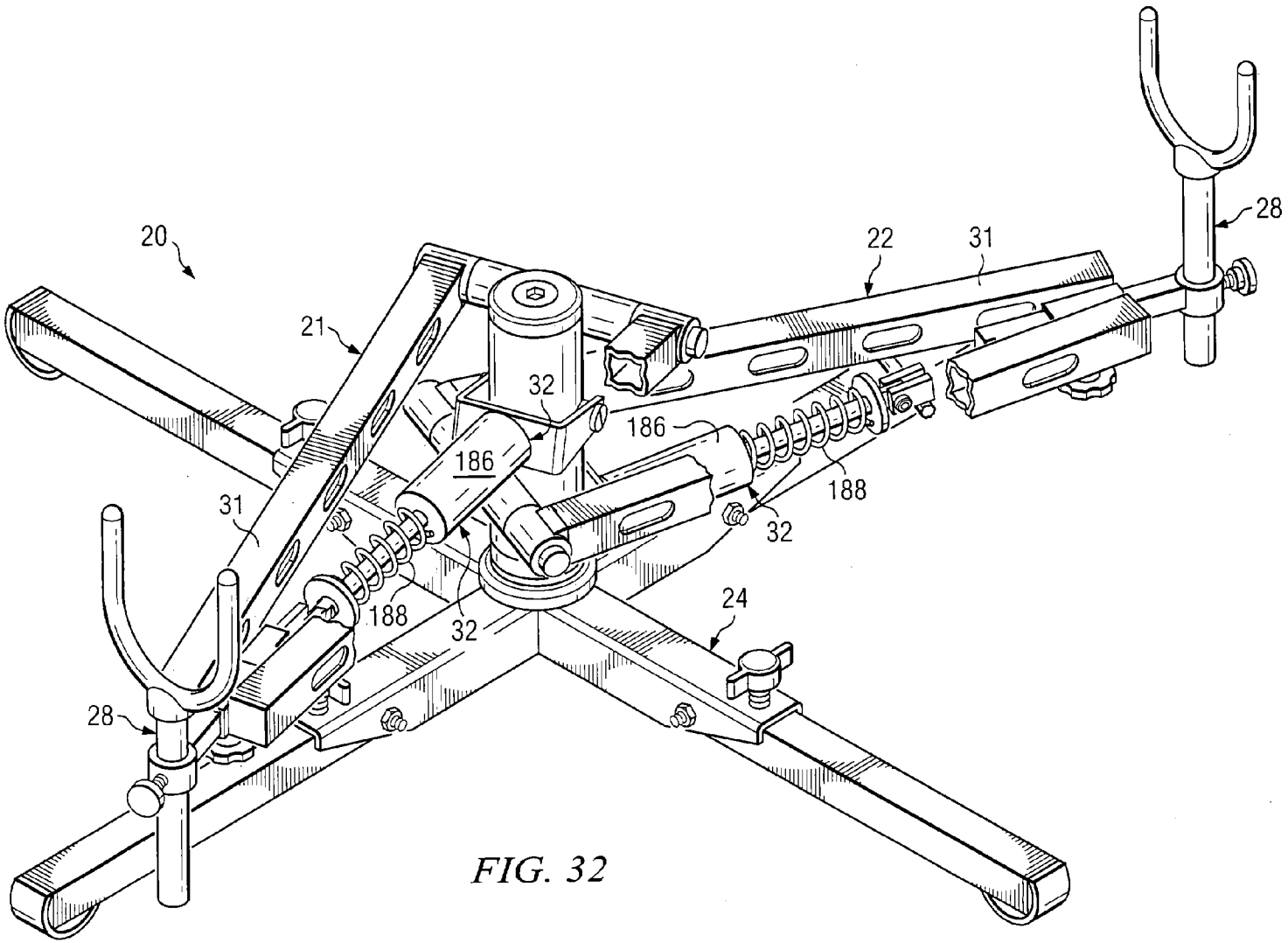
FIG. 32 is a perspective view of an eighteenth embodiment of the present invention.
Figure 40:
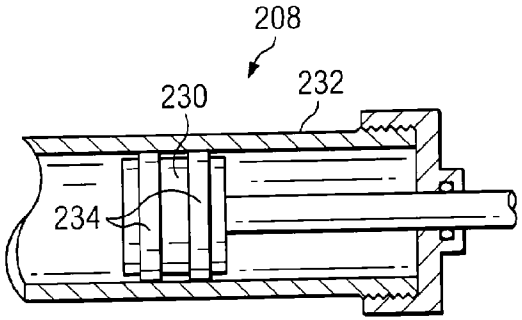
FIG. 40 is an enlarged cut-away view of a second link of the twenty-first embodiment.

FIG. 32 shows an eighteenth embodiment of the present invention. In this embodiment, the second link 32 is the slider link, such that the variable length of the second link 32 is due to a slider mechanism thereof. The second link 32 may include a dampener portion 186 and a spring portion 188, as shown in FIG. 32, for example. The second link 32 may include a piston portion and a cylinder portion, where the piston portion is adapted to slidably fit within the cylinder portion, for example. In another embodiment (not shown in FIG. 32), the piston portion of the second link 32 may include a friction element adapted to provide a certain coefficient of friction (see e.g., FIG. 40, discussed below). Such a friction element may be made from a variety of materials, including but not limited to: felt, rubber, Teflon, leather, or urethane, for example. The cylinder portion also may be finished, treated, or coated to provide a certain coefficient of friction and feel. In another embodiment (not shown), the second link 32 of one or both of the arm members (21, 22) may include a dampener 186 without a spring 188 or a spring 188 without a dampener 186. Also, in another embodiment, the dampener/spring combination may be replaced with an air or gas shock, for example, which may be adjustable by varying the gas pressure therein. With the benefit of this disclosure, one of ordinary skill in the art will likely realize many other variations for providing a slider link at or for the second link on an arm member.

Also, the embodiment of FIG. 32 may be altered to include or make use of other distal support members 28. For example, distal support members 28 having clamping portions (e.g., 116 of FIG. 11) may be desired to enable a user to tilt a gun 108 up and/or down while the gun 108 is securely held by the clamps of the distal support members 28. By using slider links at or for the second link 32, a user may change his/her aim by simply moving the gun 108, while the gun rest 20 maintains support for the gun 108 and preferably, the gun rest 20 may be balanced and adapted to retain the new position until the user moves the gun 108 again. In other words, if the spring rate on spring members 188 or a coefficient of friction for a friction member is tuned properly for a certain gun 108, the gun rest 20 may retain its current position until moved by a user. Another advantage of this embodiment is that the second link 32 (e.g., with a friction element and/or dampener) may allow the user to make slight and precise movements of the gun 108 without removing his/her hands from the shooting position and while stabilizing the movement induced by the user. Also, the second link 32 may absorb shock, vibrations, or shaky movement that may otherwise be translated to the gun 108 by the user. The second link 32 of this embodiment may also prevent movement of the gun 108 while pulling the trigger, but still allow the user to make quick and smooth adjustments in aim as desired. In any of the embodiments described herein, the second link 32 and/or the first link 31 may incorporate any of the adjustable or variable length links shown herein, for example, to form other embodiments of the present invention.

Figure 33:
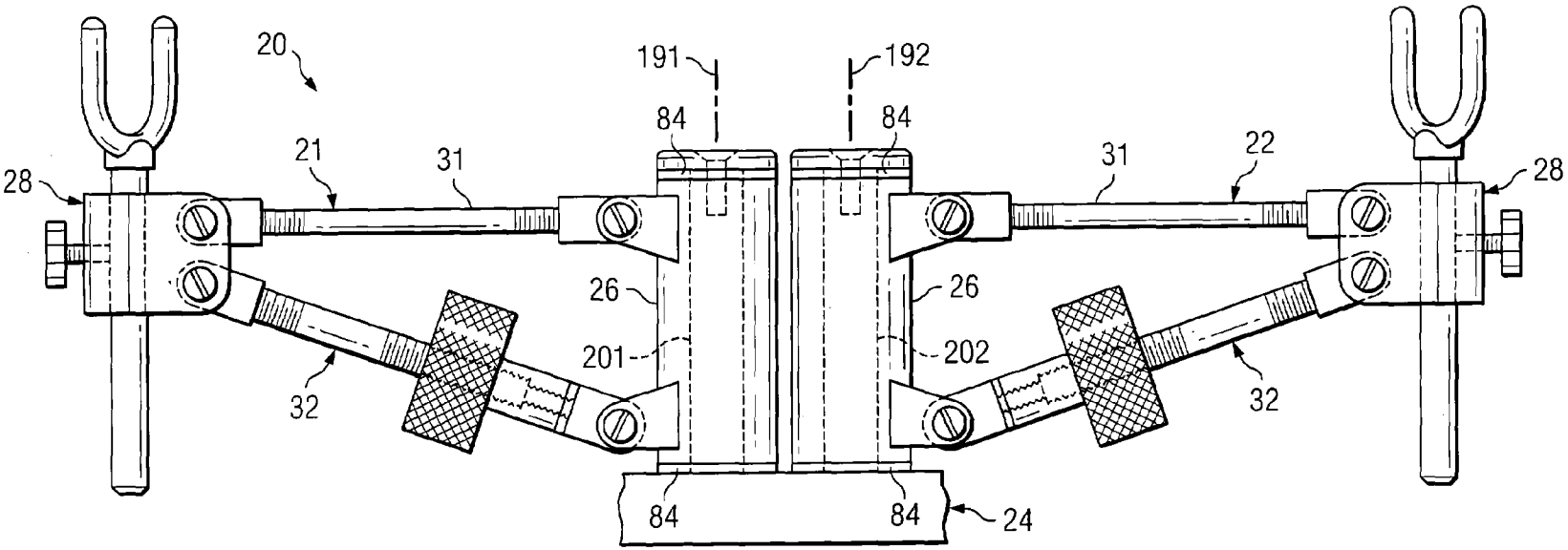
FIGS. 33–35 illustrate a nineteenth embodiment of the present invention.
Figure 34:
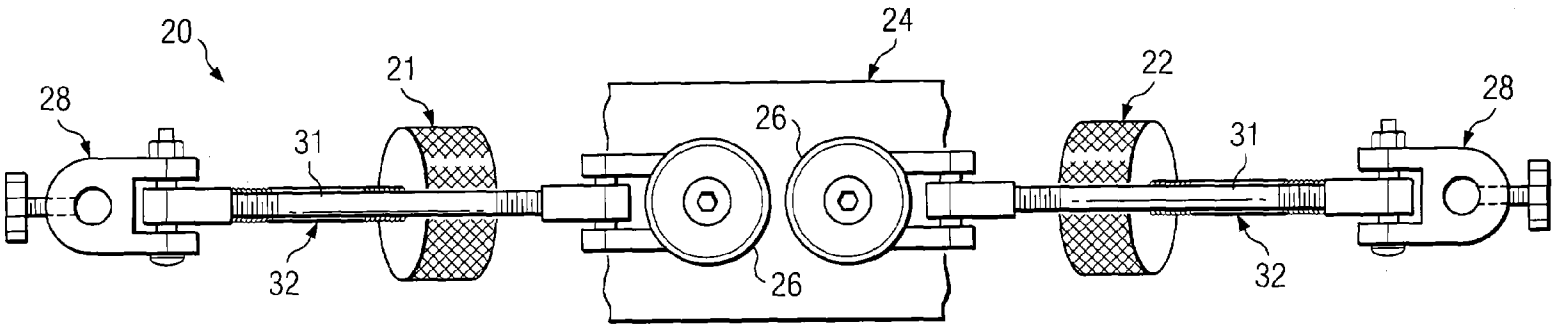
Figure 35:
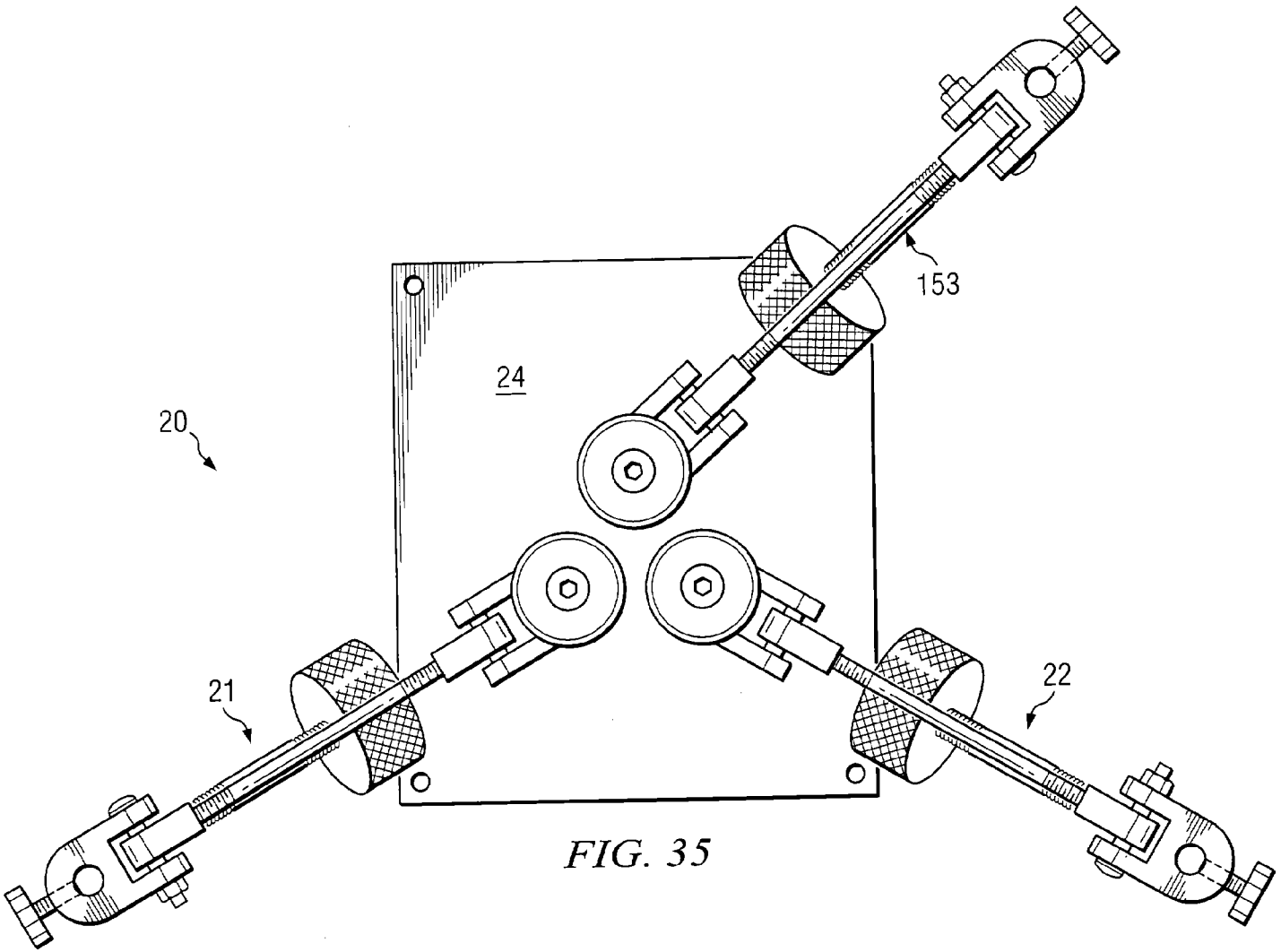

FIGS. 33–35 illustrate a nineteenth embodiment of the present invention, in which the arm members 21, 22 are configured to pivot about different axis 191, 192 (not coaxially aligned pivot axis). FIG. 33 is a side view and FIG. 34 is a top view, in which part of the base portion 24 is not shown (for purposed of simplifying the drawings). Referring to FIG. 33, each arm member 21, 22 may pivot about a separate upright shaft 201, 202 of the base portion 24. The first link 31 and the second link 32, each may be pivotably coupled to the upright member 26 and the distal support member 28, as shown in FIG. 33. The first link 31 may have a fixed or adjustable length. The second link 32 preferably has an adjustable length. In FIG. 33 the second link 32 shown with a threaded shaft 52 that mates with a knob portion 54. In other embodiments, however, the second link 32 may include a slider mechanism (e.g., piston-in-cylinder configuration with or without friction element, gas, shock, dampener, and/or spring). The washer 84 used between the upright member 26 and the base portion 24 (e.g., about the upright shaft 201, 202) may be selected so that a certain coefficient of friction is provided to restrict pivotal movement of the arm members 21, 22. In addition or in alternative, set screws (not shown in FIGS. 33–35) may be used to retain the position of an arm member 21, 22 relative to the base portion 24. Also, many different variations of the base portion 24 (e.g., as discussed above) may be incorporated into the nineteenth embodiment.

FIG. 35 shows a variation on the nineteenth embodiment, in which a third arm member 153 (identical to the first and second arm members 21, 22 in this example) is incorporated. Thus, any number of arm members may be incorporated into an embodiment of the present invention. Also, with the benefit of this disclosure, it should be apparent that the nineteenth embodiment may be combined with other embodiments described herein to provide a hybrid or combination thereof. For example, the sixth embodiment shown in FIG. 11 may be modified to include a third (or third and fourth) arm member 153 from the nineteenth embodiment to form a combination of these embodiments. Another feature to note in the nineteenth embodiment is that there are no welded portions, which may be preferred for ease in manufacturing. The parts shown in FIGS. 33–35 all may be cast, forged, and/or machined, for example. Some of the parts used on an embodiment of the present invention may be over-the-counter or off-the-shelf parts provided by one or manufacturers (e.g., bolts, shafts) needing little or no modification.

Figure 36:
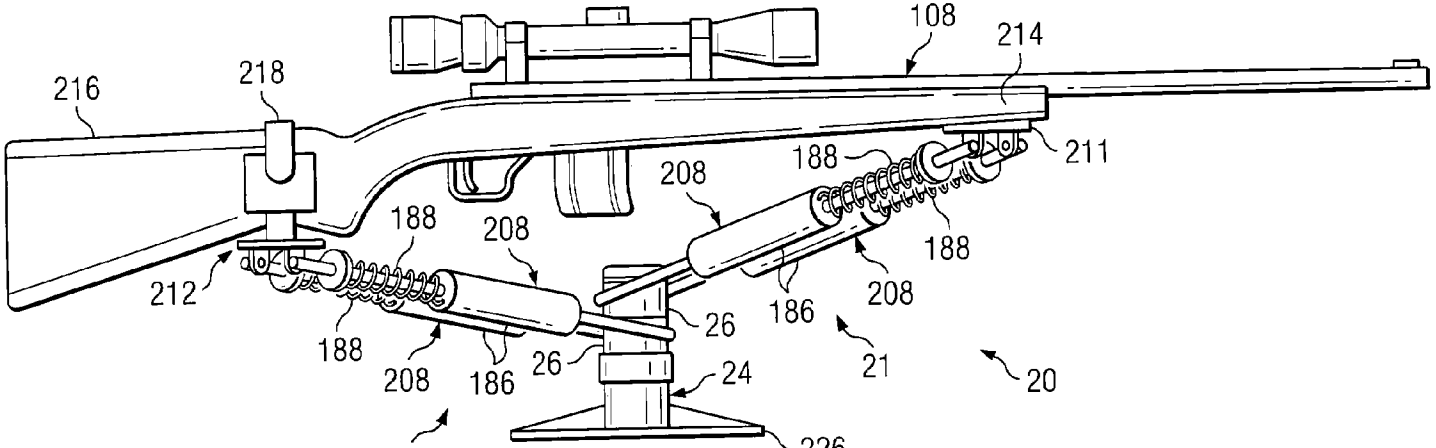
FIGS. 36 and 37 illustrate a twentieth embodiment of the present invention.
Figure 37:
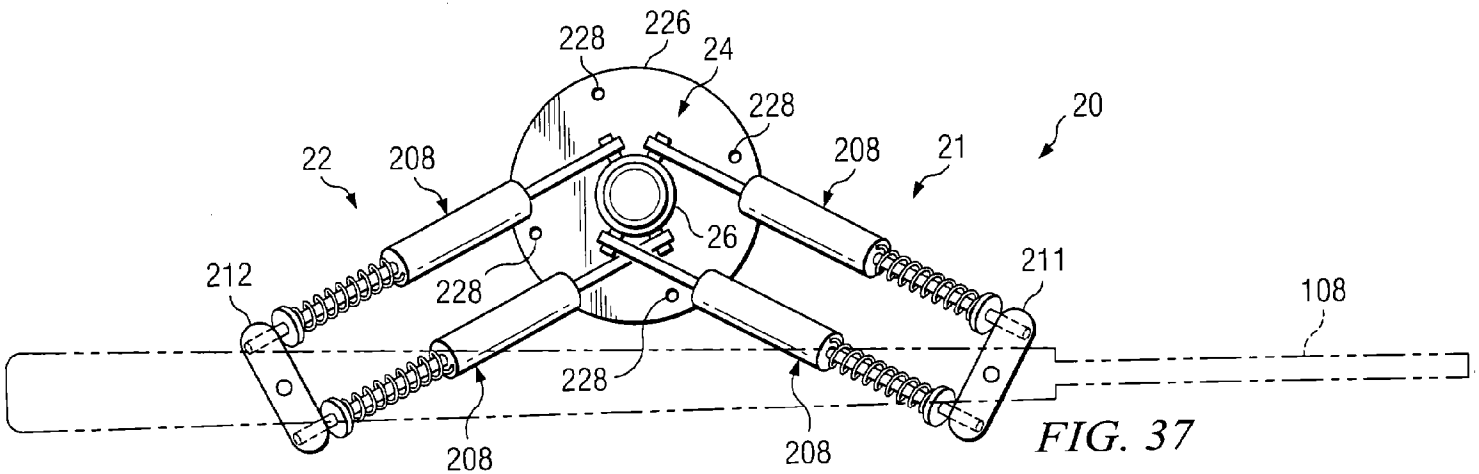

FIGS. 36 and 37 illustrate a twentieth embodiment of the present invention. In this embodiment, an arm member 21, 22 may include an upright member 26, a distal support member 28, and a slider mechanism 208. The slider mechanism 208 may be pivotably coupled to the upright member 26 and pivotably coupled to the distal support member 28, as shown in FIGS. 36 and 37, for example. The slider mechanism 208 may include (but is necessarily not limited) a piston-in-cylinder configuration (with or without a friction element), a gas shock, a dampener, and/or a spring member, for example. In the example shown in FIGS. 36 and 37, each arm has two slider mechanisms 208, and each slider mechanism 208 includes a dampener 186 and a spring member 188. The distal support members 28 are preferably adapted to be removable attached to the gun 108. For example, in FIGS. 36 and 37, a first distal support member 211 is bolted to a threaded hole (not shown) on the fore stock 214 of the gun 108, and the second distal support member 212 is strapped to the shoulder stock portion 216 of the gun 108. Some guns have one or more threaded holes formed in the stock for attaching a shoulder strap, for example. Such threaded holes may be used to retain the gun 108 to the gun rest 20 in some cases. The strap 218 of the second distal support member 212 may be made from a variety of materials, including but not limited to: leather, canvas, nylon, or rubber, for example.

Figure 38:
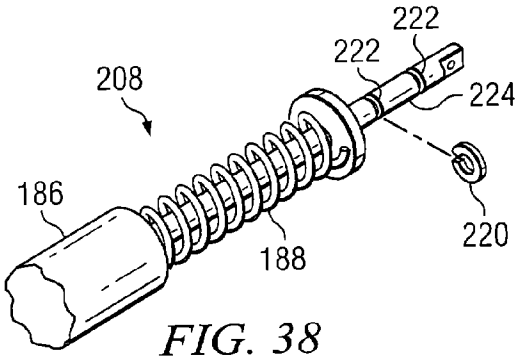
FIG. 38 is an enlarged view of a second link for the twentieth embodiment.

The spring rate and/or preloading of the spring members 188 for the embodiment shown in FIGS. 36 and 37 may be chosen, varied, and/or tuned for a specific gun or group of guns, as the weight of different guns varies, to provide an optimum balance for the gun rest 20. FIG. 38 shows one way the spring preload may be varied and/or different springs may be substituted. As shown in FIG. 38, a retainer collar 220 may be removable attached within a groove 22 formed in a shaft 224 of the slider mechanism 208. Some or all of the pivot points where the slider mechanisms 208 attach may be held in place by pins. Such pins may be removable without tools to provide a tool-free assembly/disassembly of the gun rest 20. Furthermore, the springs 188 may be changed to fine tune the suspension of the gun rest 20 and the feel of the gun rest 20 during movement of the gun 108. If desired, the springs 188 may be removed and the gun rest 20 may be used without the springs 188. Furthermore, as an optional feature or included with the gun rest 20, different slider mechanisms may be swapped to make the gun rest 20 adaptable to different gun weights and sizes. For example, the gun rest 20 may come with a variety of slider mechanisms 208 with different lengths and/or stiffnesses. Likewise, the gun rest 20 may come with a variety of springs 188 that may be swapped. Such features may also be sold separately as optional accessories, for example. The same may be true for other embodiments of the present invention as well (e.g., interchangeable second link options). Also, in another embodiment, the dampener/spring combination may be replaced with an air or gas shock, for example, which may be adjustable by varying the gas pressure therein.

The base portion 24 of the twentieth embodiment may have a flat-bottom stand portion 226, as shown in FIGS. 36 and 37, for example. The stand portion 226 preferably has attachment holes or bolts extending therefrom. In FIGS. 36 and 37, the stand portion 226 has attachment holes 228. Hence, the base portion 24 may be bolted to another object (e.g., table, vehicle, stand, tripod). Also, stakes (not shown) may be driven into the ground,through the attachment holes 228 to secure the base portion 24 to the ground. In another embodiment (not shown), the base portion 24 may include legs that are adapted to be secured to the ground. For example, such legs may have spiked or barbed leg tips (not shown). In alternative, the tips of the legs may have platforms with attachment holes formed therein (not shown), through which stakes may be driven into the ground. With the benefit of this disclosure, one of ordinary skill in the art will likely realize many other variations on the base portion 24 and/or legs of a base portion that may be readily implemented into an embodiment of the present invention to suit a given application or use.

Figure 39:
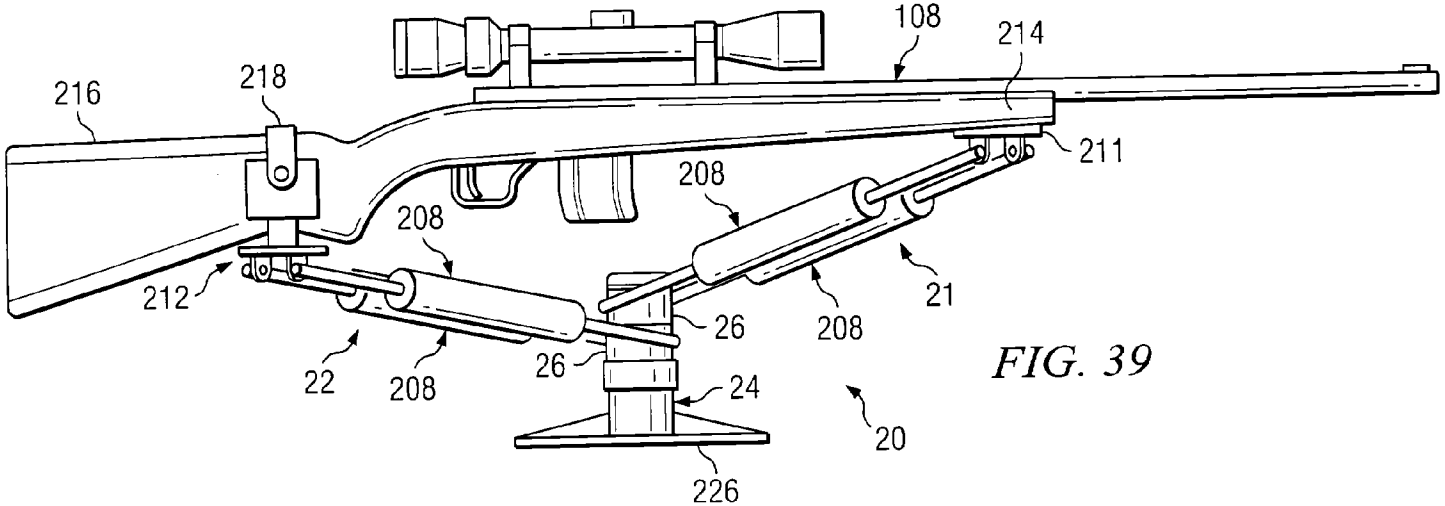
FIG. 39 is a perspective view of a twenty-first embodiment of the present invention.

FIG. 39 shows a twenty-first embodiment of the present invention, which is a variation on the twentieth embodiment. In this embodiment, the slider mechanisms 208 include a piston portion 230 and a cylinder portion 232, as show in detail in FIG. 40. The piston portion 230 may have interchangeable friction elements 234 to provide a certain coefficient of friction between the piston portion 230 and cylinder portion 232 as they are moved relative to each other. Hence, the number and type of friction elements 234 may be varied by a user to fine tune the movement and feel of the gun rest 20 while moving the gun 108 during operation of the gun rest system.

One of the advantages of the twentieth and twenty-first embodiments is that a user may quickly, controllably, and smoothly change his/her aim on a moving target with perhaps greater precision and control than a person not using a gun rest 20 of the present invention. The slider mechanisms 208 may absorb and/or compensate for shocks, vibrations, and/or erratic movements between the user and the gun. For example, some users may have unsteady hands and/or weak arms. A gun rest 20 of the present invention may thus improve the precision and accuracy of such person's shooting ability. Also, firing a semi-automatic, burst-fire, or fully-automatic weapon at a high rate of bullets per minute may make the gun difficult to handle or difficult to maintain aim. An embodiment of the present invention may provide enhanced stability and control of such firearms during such use. This may be particularly important to a soldier in a combat situation, for example, where the soldier must quickly fire at multiple targets in a short period of time. Also, in such combat situations where the adrenaline levels are high, it is often difficult to keep a steady hand. An embodiment of the present invention may compensate for a person's shaking hands and/or quick or heavy breathing. Furthermore, an embodiment of the present invention may be used from a moving vehicle to help the shooter maintain stability of the gun 108 through the suspension system of the gun rest 20. Hence, an embodiment of the present invention may provide tactical advantages for a soldier or other users (e.g., big game hunters). An embodiment of the present invention may also be useful to an animal handler, zoo keeper, and/or veterinarian attempting to hit a particular location on an animal with a tranquilizer gun, for example.

Figure 41:
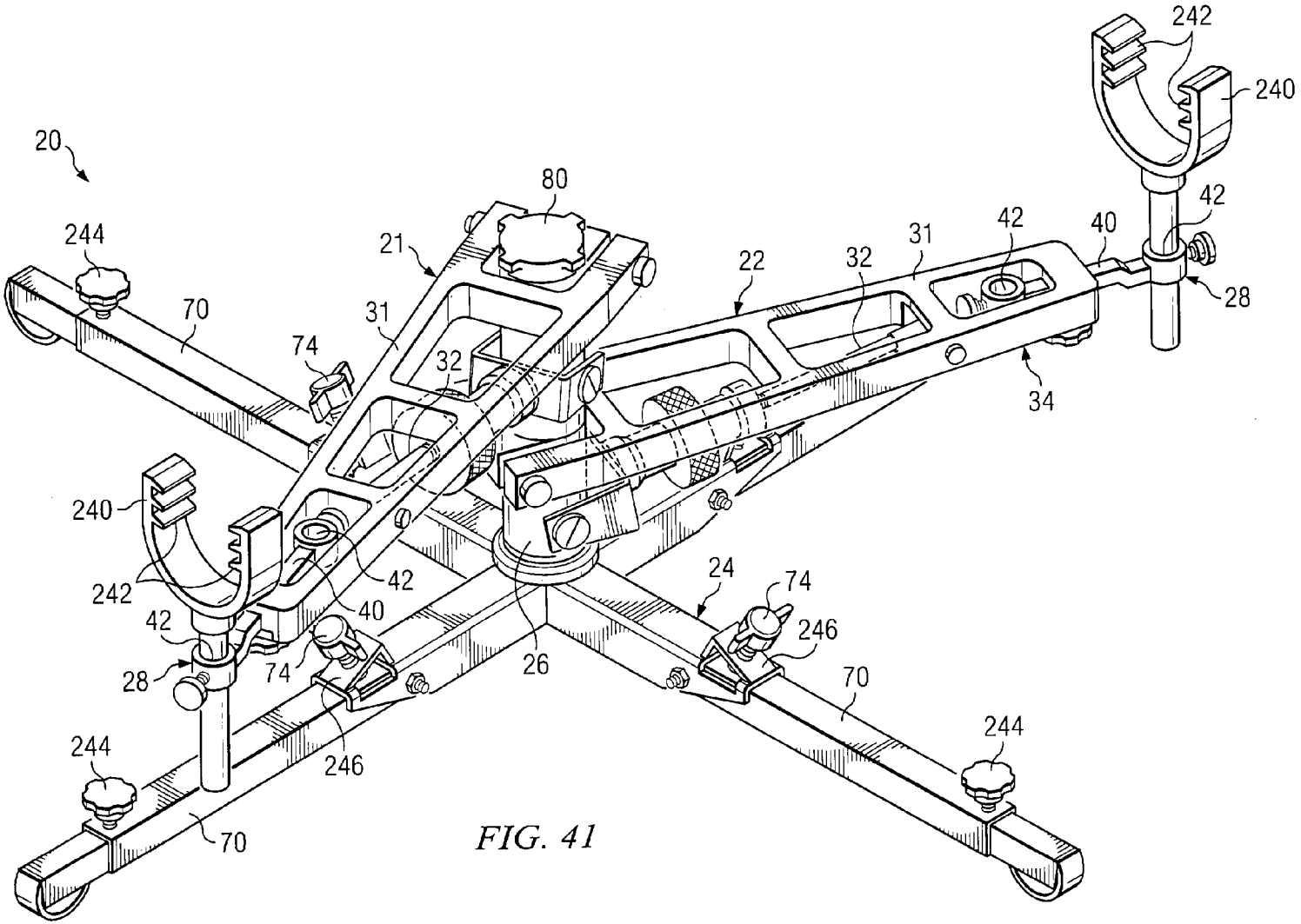
FIGS. 41 and 42 are perspective views of a twenty-second embodiment of the present invention.
Figure 42:
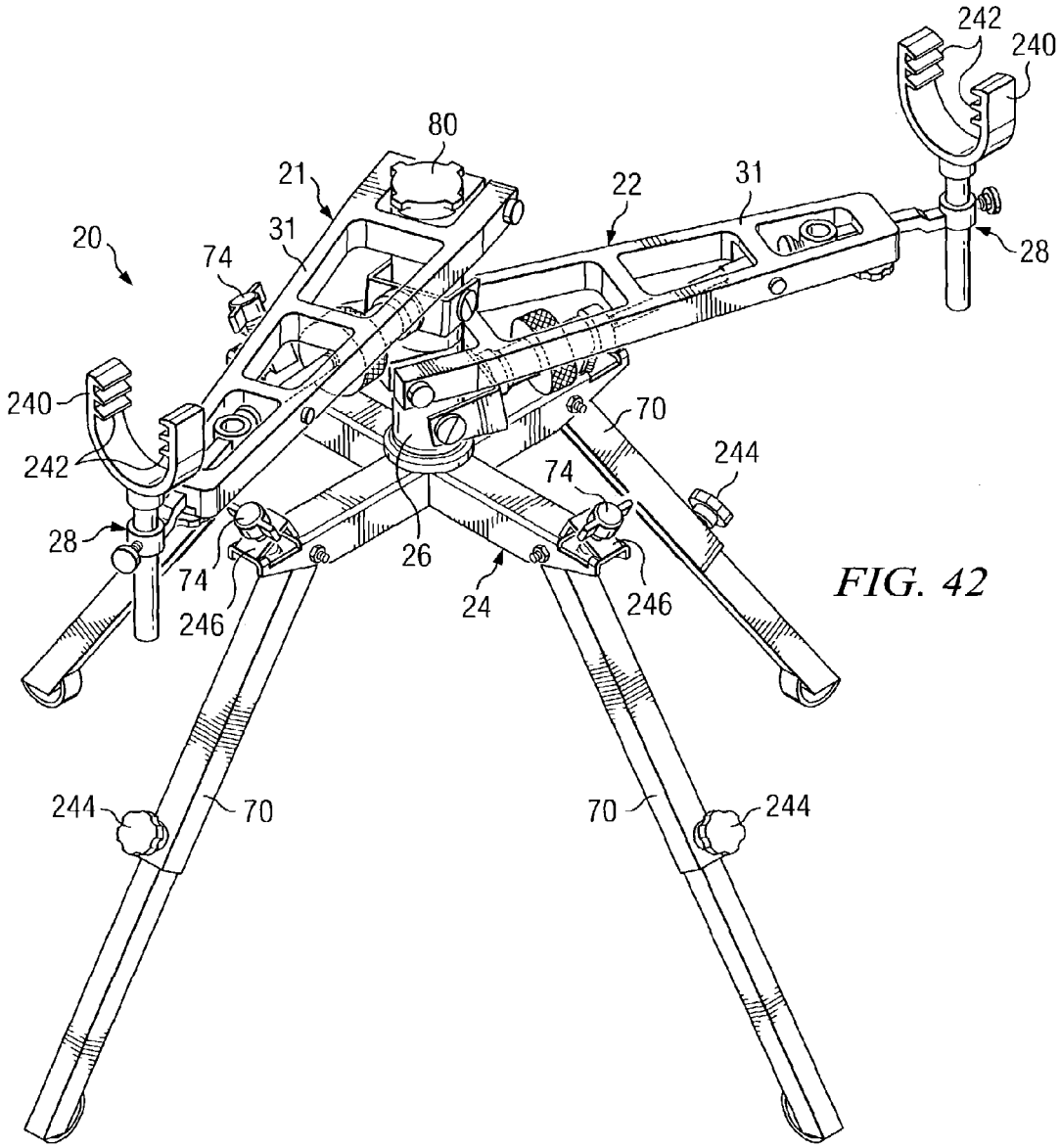

FIGS. 41 and 42 are perspective views of a twenty-second embodiment of the present invention. As illustrated by this embodiment, the first link 31 may be machined from a single piece of material (e.g., aluminum) to provide a weld-free implementation of the first link 31. The distal support members 28 may include a generally U-shaped (or V-shaped, as another example) cradle portion 240 having fins 242 extending toward the inside of the cradle portion 240, for example, as shown in FIG. 41. In a preferred embodiment, the fins 242 may be made from rubber, for example. The fins 242 may allow for a wide variety of gun stock shapes and sizes to fit within a single cradle, which increases the versatility of the gun rest 20. Also, the fins 242 may provide dampening for vibrations and shocks to and/or from the gun (depending upon the shape and material of the fins). Preferably, the fins 242 are flexible material. The shape, length, and/or material(s) of the fins 242 may vary. During manufacturing, the fins 242 may be molded or cut from a block of rubber with a water jet, for example. In the embodiment shown in FIG. 41, the fins 242 project from the cradle arms at a downward angle to act like barbs. Hence, after a gun stock is inserted into the cradle portion 240, the fins 242 may hinder the gun 108 from being lifted out of the cradle portion 240 (e.g., as the gun kicks) and may help keep the gun 108 within the cradle 240 (e.g., if the gun rest 20 is moving—attached to a moving vehicle). In other embodiments, however, the fins 242 may be positioned at different angles.

Still referring to FIGS. 41 and 42, the legs 70 of this embodiment have adjustable length and adjustable angles. In FIG. 42, the legs 70 of the gun rest 20 are shown in a raised and extended configuration to allow the gun rest 20 to be used from a seated or kneeling position, for example. However, when the legs 70 are retracted and the angle of the legs 70 relative to the base portion 24 is flattened, as show in FIG. 41, the gun rest 20 may have a configuration similar to that shown in FIG. 1 (the first embodiment). Leg extension set screws 244 may be included to secure and retain the length of the legs 70 after making adjustments. Preferably, the leg extension set screws 244 include knobs to allow for tool-free adjustments, as shown in FIG. 41. Leg screw brackets 246 may be incorporated in an embodiment, as shown in FIG. 41, along with longer leg adjustment set screws 74 to provide the ability to obtain wide range of adjustment of the legs 70, and thus a wide array of configurations/positions for the base portion 24. Hence, the twenty-second embodiment shows yet another variation on the base portion 24, which may be implemented into any of the other embodiments of the present invention. One of the advantages of the base portion 24 for the twenty-second embodiment (shown in FIGS. 41 and 42) is that a user may use the gun rest in a prone/lying-down position or in a seated or kneeling position. In another embodiment, the legs 70 may be extendable by another segment (not shown in FIGS. 41 and 42) to provide a higher position (e.g., standing position) for the base portion 24.

Yet another feature to note on the twenty-second embodiment shown in FIGS. 41 and 42 is that the slider shaft 40 may include two attachment holes 42; one inside the first link 31 and another outside the first link 31. This provides a variety of locations and adjustment configurations for positioning a cradle portion 240 (or other holder portion) of the distal support member 28. Also, one of the attachment holes 42 may be located higher than the other, such that a side view of the slider shaft 40 is generally S-shaped. Hence, the slider shaft 40 may be flipped to make the outer attachment hole 42 higher or lower, as desired, to providing additional versatility and adjustability for the gun rest 20.

It is often desirable or necessary to adjust the gun barrel left or right to compensate for the wind direction and wind velocity. Such adjustment is often referred to as a windage adjustment. An embodiment of the present invention may allow for gross windage adjustment by simply pivoting one or more of the arm members 21, 22 about the base portion 24. For some applications it may be desirable to have a more precise and minute windage adjustment.

Figure 43:
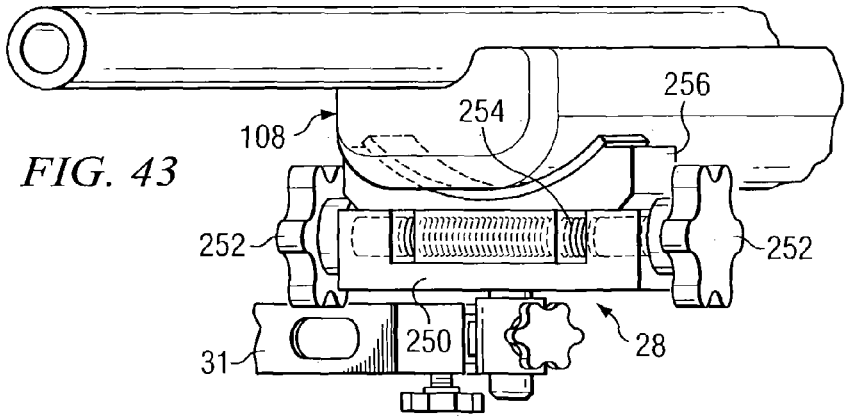
FIG. 43 is a perspective view of a windage adjustment member.

FIG. 43 shows another variation for a distal support member 28, which provides the ability to perform minute and precise windage adjustments. The distal support member 28 of FIG. 43 includes a windage adjustment member 250. The windage adjustment member 250 may have adjustment knobs 252 that actuate a common lead screw 254. The single lead screw 254 extends from one knob 252 to the other knob 252. In other embodiments, only one knob 252 may be used. An advantage of having two knobs 252 is that a user can adjust the windage using either hand. Turing either knob 252 causes the lead screw 254 to turn, which causes a support block 256 to slide left or right. The gun 108 is resting on the support block 256. Hence, as the support block 256 is moved left or right be the lead screw 254, the gun 108 is moved left or right, which changes the angle of the gun 108 relative to the target. For example, one turn on the knob 252 may translate to a movement of several inches at a long-range target. The thread pitch may be varied on the lead screw 254 to provide different amounts of sliding movement (for the support block 256) per knob turn.

Many variations and types of distal support members 28 have been discussed herein. It should be noted that any of the distal support members 28 may be used on any other embodiment of the present invention, and different distal support members 28 may be combined to provide other variations and combinations.

In many existing gun rests, lateral or left/right movement requires a movement of the entire gun rest and/or an extension of an arm away from the base resulting in an increased moment arm, both of which are undesirable for certain applications. Increasing the moment arm while adjusting a gun rest may decrease the stability of the gun rest at the new position. An advantage of an embodiment of the present invention is that both arm members 21, 22 may be pivoted together about the base portion to perform lateral or left/right adjustments while maintaining the same stability. Both the fore and aft of the gun rest may be adjusted while moving the gun aim left or right. Hence, the stability of the gun and the gun rest may be unaltered by a lateral movement of the gun position when pivoting the arm members 21, 22 about the base portion 24. Another advantage of an embodiment of the present invention is that the arm members 21, 22 may be moved together or separately while adjusting the lateral aim and/or the elevation of the gun.

Although the figures herein have shown the gun 108 supported by both arm members 21, 22, a user may use only one of the arms 21 or 22 to support a portion of the gun. While using only one of the arms 21 or 22, the other arm member may be pivoted to a position out of the way. Even when only one of the arms 21 or 22 is used, an embodiment of the present invention still provides many advantages to a user. For example, some people are not strong enough to hold heavy rifles with a steady hand or to hold the gun comfortably due to the weight of the gun. By allowing the gun rest 20 to support part of the gun's weight with one of the arm members 21 or 22, a user may be able to comfortably handle larger or heavier guns.

Many existing gun rests require the user to adjust his/her body position to the gun while using a gun rest. An advantage of an embodiment of the present invention is that the gun rest 20 may be adjusted to the users position due to the versatility of the gun rest 20. A gun rest 20 of the present invention may be adjust from a low position (close to the ground/surface) to a seated position (legs extended or partial extended) to a standing position (legs fully extended), for example. Thus, a gun rest 20 of the present invention may be adjusted for a wide range of heights for the support arms 21, 22 to adapt to a wide range of user positions (e.g., lying prone, kneeling, sitting on ground, sitting at a table, sitting in a chair, standing).

Another advantage of an embodiment of the present invention is that the shooter may keep his/her eyes on the target while making any adjustment (left, right, up, down) to any part of the gun rest 20. In a preferred embodiment, all of the adjustments may be made by hand (without tools) using ergonomic adjustment knobs. Preferably, the arm members 21, 22 may be locked into place relative to the base portion 24 using set screws 86 that thread into holes 88, for example (see e.g., FIGS. 2 and 6–9). Also, other parts of the gun rest 20 may be locked in place with set screws, for example. By allowing the parts of the gun rest 20 to locked in place after adjustments are made, a shooter may then concentrate on his/her breathing and trigger squeezing techniques, while allowing the gun rest 20 to support the gun. This may greatly increase the accuracy and repeatability of a person's shooting, for example.

Yet another advantage of an embodiment of the present invention is that the gun rest 20 may be easily and quickly adapted for right-handed and left-handed people by simply pivoting the arm members 21, 22 to another position. Also, a gun rest 20 in accordance with an embodiment of the present invention may provide a comfortable and natural hand rest for the trigger hand on top of the first link 31.

It will be appreciated by those skilled in the art having the benefit of this disclosure that this invention provides an adjustable and versatile gun rest apparatus having numerous uses and applications. It should be understood that the drawings and detailed description herein are to be regarded in an illustrative rather than a restrictive manner, and are not intended to limit the invention to the particular forms and examples disclosed. On the contrary, the invention includes any further modifications, changes, rearrangements, substitutions, alternatives, design choices, and embodiments apparent to those of ordinary skill in the art, without departing from the spirit and scope of this invention, as defined by the following claims. Thus, it is intended that the following claims be interpreted to embrace all such further modifications, changes, rearrangements, substitutions, alternatives, design choices, and embodiments.

What is claimed is:

1. A gun support apparatus, comprising:

a base portion;

a first arm member pivotably coupled to the base portion; and a second arm member pivotably coupled to the base portion, wherein the first and second arm members are independently rotatable about a same axis, and wherein each of the first and second arm members comprises an upright member, a distal support member having a generally U-shaped cradle portion or clamp that is adapted for supporting a gun, a first link pivotably coupled to the upright member and attached to the distal support member, such that the first link is located between the distal support member and the upright member, and a second link attached to the upright member and attached to the first link, wherein the second link has a variable length and includes a fine-tuning adjustment.

2. The gun support apparatus of claim 1, wherein the first link for at least one of the arm members has a fixed length.

3. The gun support apparatus of claim 1, wherein the first link for at least one of the arm members has an adjustable length.

4. The gun support apparatus of claim 1, wherein the second link is pivotably coupled to the upright member and the second link is pivotably coupled to the first link.

5. The gun support apparatus of claim 1, wherein the base portion comprises an upright shaft extending along the axis, wherein the first arm member is pivotably coupled to the upright shaft, and wherein the second arm member is pivotably coupled to the upright shaft adjacent to the first arm member.

6. The gun support apparatus of claim 5, wherein the upright shaft extends through the upright members of the first and second arm members.

7. The gun support apparatus of claim 5, further comprising a washer located about the upright shaft and located between the first and second arm members.

8. The gun support apparatus of claim 7, wherein the washer is made from a non-metal material.

9. The gun support apparatus of claim 1, wherein the second link for at least one of the arm members comprises:

a shaft portion having a threaded end; and a knob portion having a threaded hole formed therein, wherein the threaded end of the shaft portion is adapted to mate with the threaded hole.

10. The gun support apparatus of claim 1, wherein first link for at least one of the arm members is pivotably coupled to the distal support member.

11. The gun support apparatus of claim 1, wherein the base portion comprises three legs extending therefrom.

12. The gun support apparatus of claim 11, wherein the legs are pivotably coupled to the base portion to provide an adjustable height for the base portion.

13. The gun support apparatus of claim 11, wherein the legs have adjustable lengths.

14. The gun support apparatus of claim 1, wherein the base portion comprises a plate-shaped platform portion.

15. The gun support apparatus of claim 1, wherein the base portion comprises a tripod structure.

16. The gun support apparatus of claim 1, wherein the base portion comprises a mounting bracket adapted to clamp onto another object.

17. The gun support apparatus of claim 1, wherein the base portion comprises a storage tray extending therefrom.

18. The gun support apparatus of claim 1, further comprising a third arm member attached to and extending from the base portion.

19. The gun support apparatus of claim 1, further comprising a dampener member attached to and extending between the first and second arm members.

20. The gun support apparatus of claim 1, wherein the base portion comprises a bracket adapted for attachment to a wheelchair.

21. A gun support apparatus, comprising:

a base portion;

a first arm member pivotably coupled to the base portion;

a second arm member pivotably coupled to the base portion, wherein the first and second arm members are independently rotatable about a same axis, wherein each of the first and second arm members comprises a first link extending along a first link axis and attached to the base portion at a proximate end of the first link, and a second link extending along a second link axis and attached to the base portion at a proximate end of the second link, wherein a distal end of the second link is attached to a distal end of the first link, wherein an angle formed between the first link axis and the second link axis is less than 90 degrees, and wherein the second link includes a fine-tuning adjustment that comprises a shaft portion having a threaded end, and a knob portion having a threaded hole formed therein, wherein the threaded end of the shaft portion is adapted to mate with the threaded hole to provide a variable length for the second link.

22. The gun support apparatus of claim 21, wherein the angle formed between the first link axis and the second link axis is less than about 45 degrees.

23. The gun support apparatus of claim 22, wherein the angle formed between the first link axis and the second link axis is about 30 degrees.

24. A method of assembling a gun support apparatus, comprising:

assembling first and second arm members, wherein the assembling of each of the arm members comprises attaching a first link to an upright member, attaching the first link to a distal support member having a generally U-shaped cradle portion or clamp that is adapted for supporting a gun, such that the first link is located between the distal support member and the upright member, attaching a second link to the upright member, attaching the second link to the first link, wherein the second link has a variable length and includes a fine-tuning adjustment;

pivotably attaching the first arm member to a base portion; and pivotably attaching the second arm member to the base portion, wherein the first and second arm members are independently rotatable about a same axis.

25. A gun support apparatus, comprising:

a base portion comprising an upright shaft extending along an axis;

a first arm member pivotably coupled to the upright shaft of the base portion;

a second arm member pivotably coupled to the upright shaft of the base portion adjacent the first arm member, wherein the first arm member and the second arm member are both configured to independently pivot about the axis; and wherein each of the first and second arm members comprises an upright member, a distal support member, a first link pivotably coupled to the upright member and attached to the distal support member, such that the first link is located between the distal support member and the upright member, and a second link attached to the upright member and attached to the first link, wherein the second link has a variable length and includes a fine-tuning adjustment comprising a shaft portion having a threaded end, and a knob portion having a threaded hole formed therein, wherein the threaded end of the shaft portion is adapted to mate with the threaded hole.

26. The gun supped apparatus of claim 25, wherein the washer is made from a non-metal material.

27. The gun support apparatus of claim 25, wherein the upright shaft extends through the upright members of the first and second arm members.

* * * * *